US007263947B2

(12) United States Patent
Giewercer

(10) Patent No.: US 7,263,947 B2
(45) Date of Patent: Sep. 4, 2007

(54) EXTENDED USE REMINDER DEVICE

(76) Inventor: Harry Giewercer, 29 Hyde Park Drive, Richmond Hill, Ontario (CA) L4B 1V2

( * ) Notice: Subject to any disclaimer, the term of this patent is extended or adjusted under 35 U.S.C. 154(b) by 4 days.

(21) Appl. No.: 11/059,670

(22) Filed: Feb. 17, 2005

(65) Prior Publication Data

US 2005/0183982 A1 Aug. 25, 2005

Related U.S. Application Data

(60) Provisional application No. 60/546,989, filed on Feb. 24, 2004.

(51) Int. Cl.
*A61J 7/04* (2006.01)
*G09F 3/00* (2006.01)

(52) U.S. Cl. ..... 116/308; 116/322; 116/324

(58) Field of Classification Search ..... 116/306, 116/308, 321, 322, 323, 324, 325, 326; 24/299, 24/460, 462, DIG. 39, DIG. 41; 40/641, 40/668, 669; 403/340, 339, DIG. 11
See application file for complete search history.

(56) References Cited

U.S. PATENT DOCUMENTS

| | | | | | |
|---|---|---|---|---|---|
| 560,505 | A * | 5/1896 | Kees | 116/324 |
| 1,765,668 | A * | 6/1930 | Hartzell | 116/323 |
| 1,892,163 | A * | 12/1932 | Rose | 116/323 |
| 1,990,317 | A * | 2/1935 | Chenault | 116/306 |
| 2,480,614 | A * | 8/1949 | Spargo | 116/324 |
| 2,732,822 | A * | 1/1956 | Cassady et al. | 116/324 |
| 2,853,045 | A * | 9/1958 | Thomas | 116/324 |
| 2,910,985 | A * | 11/1959 | Epstein et al. | 40/651 |
| 3,254,432 | A * | 6/1966 | Wassell | 40/650 |
| 3,419,979 | A * | 1/1969 | McVicker et al. | 40/618 |
| 3,914,890 | A * | 10/1975 | Behlen, Jr. | 40/597 |
| 4,691,373 | A * | 9/1987 | Ausnit | 383/63 |
| 4,907,321 | A * | 3/1990 | Williams | 24/585.12 |
| 5,054,127 | A * | 10/1991 | Zevchak | 2/247 |
| 5,765,501 | A * | 6/1998 | Tung et al. | 116/323 |
| 5,778,818 | A * | 7/1998 | Marshall | 116/313 |
| 5,979,356 | A * | 11/1999 | Emery | 116/324 |
| 5,979,698 | A * | 11/1999 | Deal | 221/2 |
| 6,290,392 | B1 * | 9/2001 | Sandor | 383/33 |
| 6,442,804 | B2 * | 9/2002 | Turvey et al. | 24/399 |
| 6,571,430 | B1 * | 6/2003 | Savicki et al. | 24/30.5 R |
| 6,723,408 | B2 * | 4/2004 | Hillemann et al. | 428/40.1 |
| 2003/0211268 | A1 * | 11/2003 | Hillemann et al. | 428/40.1 |
| 2005/0281492 | A1 * | 12/2005 | Turvey et al. | 383/64 |

FOREIGN PATENT DOCUMENTS

WO WO 2007009605 A * 1/2007

* cited by examiner

*Primary Examiner*—R. Alexander Smith

(57) ABSTRACT

An extended use reminder device (100) operable on the exterior flat or curved surface of an article includes a selectable member (102) including a plurality of individually selectable positions. The selectable member comprises a deformable plastic structure (110) or plurality of plastic structures attached to a deformable sheet member (112). A movable pointer or selector (106) securely interlocks with the plastic structure at one of the selected positions to form a reminder. A single device fits a great variety of containers and allows for a high degree of customization. The device is suitable for manual or automated assembly and application to a container.

35 Claims, 11 Drawing Sheets

FIG. 1
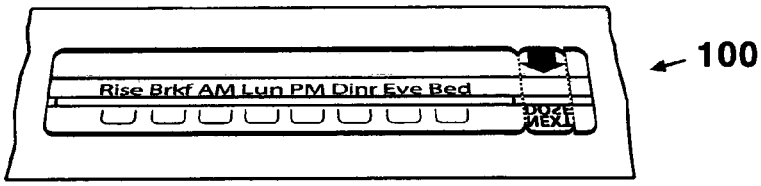
FIG. 2
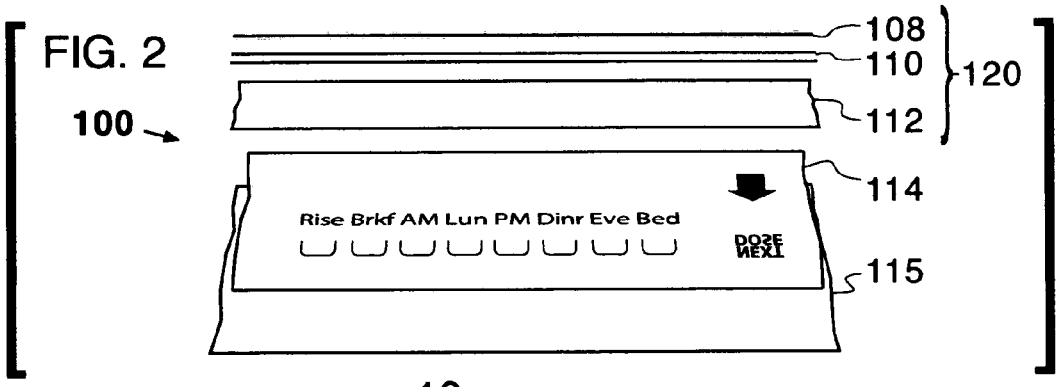
FIG. 3
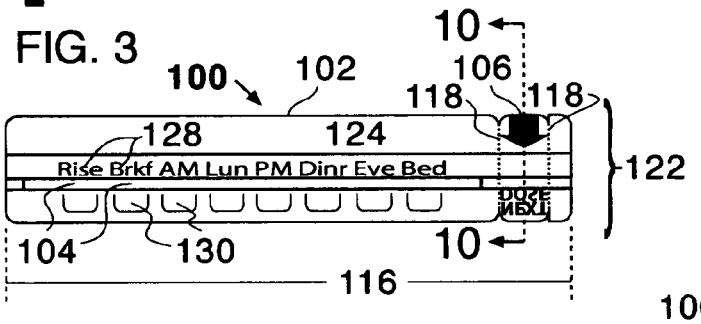
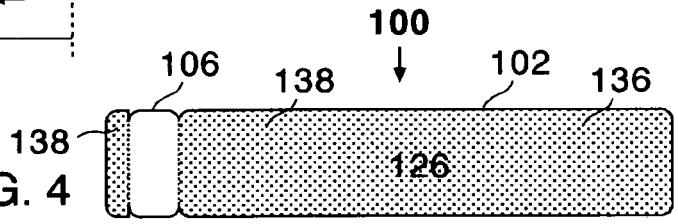
FIG. 4
FIG. 5
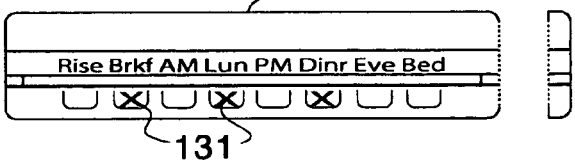
FIG. 6
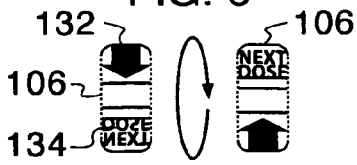
FIG. 7
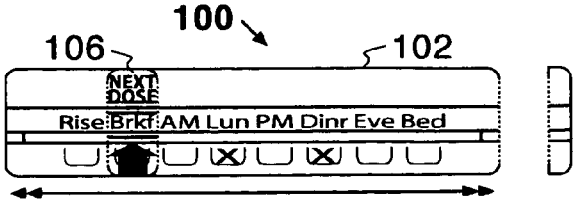

FIG. 40
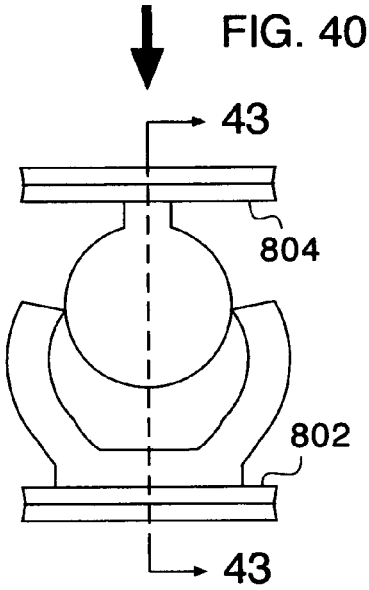
FIG. 41
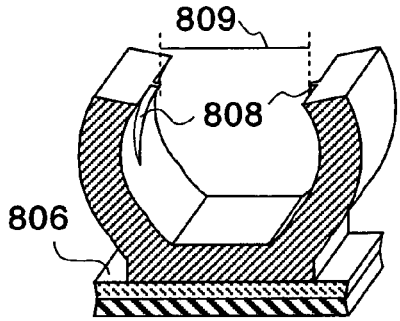
FIG. 43
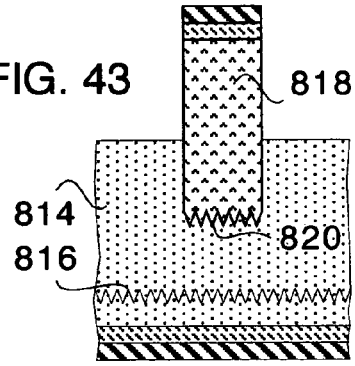
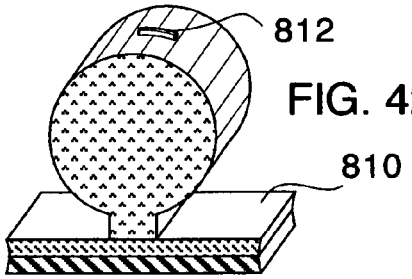
FIG. 42
FIG. 45
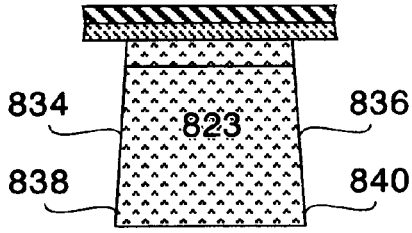
FIG. 44
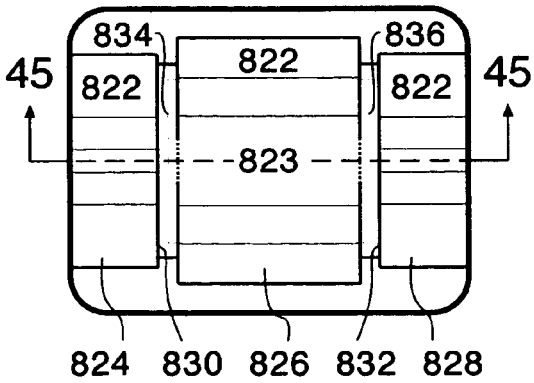
FIG. 46
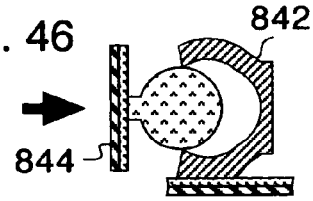

FIG. 56
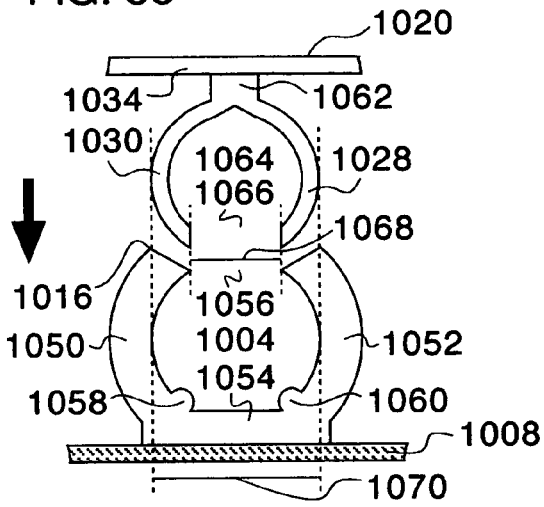
FIG. 57
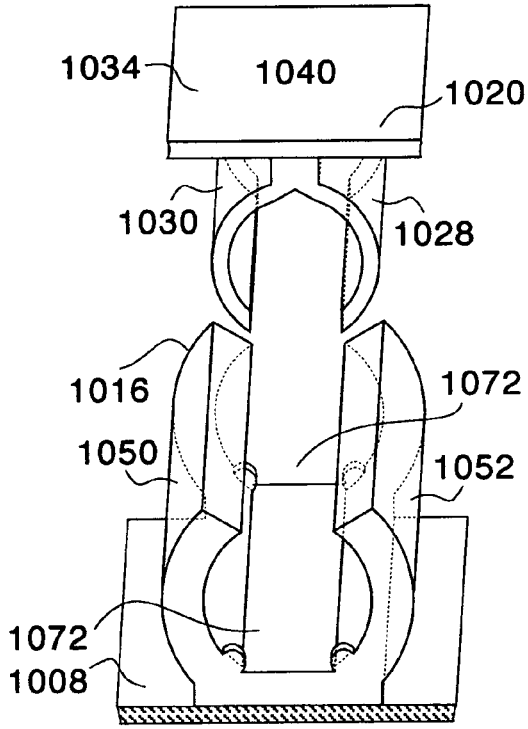
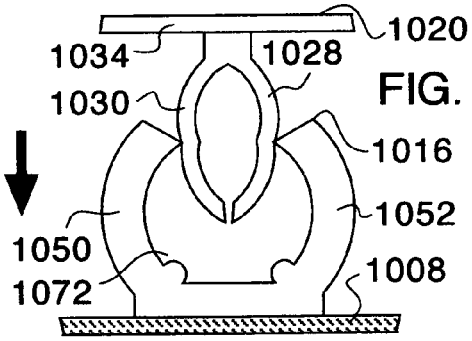
FIG. 58
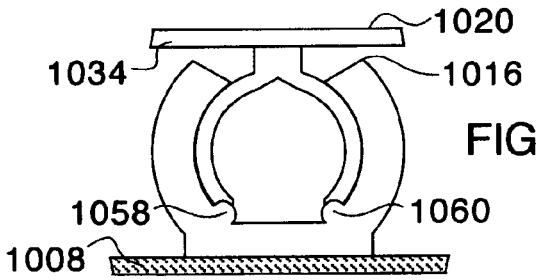
FIG. 59
FIG. 60
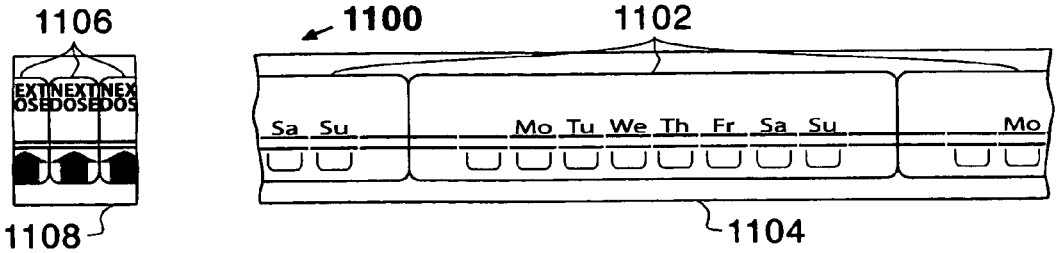

EXTENDED USE REMINDER DEVICE

CROSS-REFERENCE TO RELATED APPLICATIONS

This application is based upon provisional application No. 60/546,989 filed on Feb. 24, 2004, titled Extended Use Reminder Device.

BACKGROUND OF THE INVENTION

1. Field of the Invention

The present invention relates to a cost-effective device for reminding a user to perform a task or reminding a user when a task was performed. The device, which may be attached to an article, is engineered for extended use and remains functional under a variety of commonly challenging environmental conditions. When used in conjunction with a particular medication, the invention provides a simple visual representation of the patient's dosage schedule and when the next dose is due or when the last dose was taken.

2. Description of the Background Art

Extremely adaptive and inexpensive interactive reminder devices for use with medication containers have been disclosed. The disclosure of co-pending U.S. patent application Ser. No. 10/050,520 filed Jan. 18, 2002 and Ser. No. 10/212,761 filed Aug. 7, 2002, are incorporated herein by reference for the purpose of showing the various reminder device constructions and materials, manufacturing and application methods that may be associated in certain executions of reminder devices. Co-pending U.S. patent application for a "SECURABLE MEDICATION REMINDER DEVICE" Ser. No. 10/899,121 filed Jul. 27, 2004, the contents of which are also incorporated herein by reference for the same purposes, discloses improvements. The improvements include the use of a repositionably adherable portion in a member of the device to secure the selection of a chosen position (indicating the time for the next dose). Improper handling of these devices or use in adverse environments decreases adherence life. Transfer of oil from fingers, airborne contaminants, ambient temperature fluctuations and climate extremes can shorten usefulness. In some instances, such as when a high frequency regimen is coupled with a large quantity of medication, the longevity of the reminder can be exceeded. It would be of great value, when conditions dictated, to have a more robust device that substantially maintained the benefits of the aforementioned reminders.

Historically, purchase and preparation of food in quantities too large to consume in one sitting gave rise to a multitude of storage containers. The ability to seal well, store at freezer and refrigerator temperatures, and heat in the microwave oven, has fostered the growth of reusable plastic containers. While the best of such containers (ex. Tupperware) are relatively expensive, they perform well and some include an integral reusable reminder, a convenient cost-saving feature. Still, their cost has been a barrier to wider distribution. More recently, competitive more affordable reusable containers such as those disclosed in U.S. Pat. No. 6,170,696, the contents of which are incorporated here by reference, have become available and are gaining widespread use. They deliver many of the benefits of the costlier containers, but do not provide a storage reminder. A low-cost reusable reminder device that could be attached to these newer containers would add considerable value for the user.

One recent approach to a reusable reminder can be seen in U.S. Pat. No. 6,796,267 to DuBarry. A molded base is vertically attachable to a medication container by adhesive or other mechanical means. A series of labeled arms independently pivot in the base frame in order to make a selection. The arms may be integrally molded and integrally hinged with the base or separately produced and then assembled with the base. The procedure for operating the device in conjunction with the taking of medication would require that the user reset the schedule after every cycle, every week in the case of one embodiment. It is not clear how this would serve as an effective or convenient reminder when medication is consumed only on certain days of the week or several times a day. The potential for confusion and error is significant. Manipulation of the necessarily small arms would present an additional concern for many users. Customization for an individual patient requires that a great number of different schedule devices be manufactured or that that the user or health-care provider possess the demanding skill and dexterity necessary to customize the device.

Another approach to a reusable reminder can be seen in U.S. Pat. No. 5,979,698 to Deal. Movable components are limited to a selector, which is anti-displaceably held on a longitudinal strip (curved along width) by a raised button or depression having scheduling indicia. Squeezing opposite ends of the selector at the sides of the selectable member inwardly to deform the selector over the button or depression, longitudinally moving the selector along the strip to a new selectable position while engaged, and releasing the selector, selects a new schedule position. Although the procedure is far less confusing (than DuBarry) and does not require a cycle reset, grasping and squeezing the tiny selector while moving to a new position would appear to be quite challenging for many. Additionally the design dictates that squeezing the selector likely increases the total frictional contact force between the selector and the strip, making longitudinal movement of the selector along the strip even more difficult. Furthermore, given operation and structure of the device, assembly of the selector with the strip only seems possible by longitudinally sliding an end of the selector onto the strip at a longitudinal end of the strip, a hard task for many individuals. Construction and operation appear to limit device attachment to curved wall containers only and only with the longitude of the strip along the vertical orientation on the wall of the container. Customization for an individual patient would present difficulties similar to those in DuBarry.

While the relatively small parts in the DuBarry and Deal devices would challenge the manipulation capabilities of many patients, the device designs produce considerably large protrusions in undesirable locations on the wall of a container. These protrusions can interfere with patient ability to grasp the container when opening and closing the lid, particularly on small containers and those with safety closures.

SUMMARY OF INVENTION

The invention is a simple reminder device, which allows for extended use under commonly challenging environmental conditions. The device includes a highly customizable schedule member having a plurality of securely selectable positions. The schedule member comprises a deformable plastic structure or plurality of plastic structures attached to a deformable sheet. A single portion of the plastic structure or a single plastic structure references a single selectable position on the schedule. A movable pointer or selector retentively interengages with the plastic structure and is slideable to each of the selected positions to form a reminder. The selector can be separately manufactured in a variety of materials and methods or similarly produced in conjunction with the schedule member. The device, which is suitable for use on flat or curved surfaces, can be inexpensively produced and assembled on high-speed equipment using current manufacturing schemes. The device can be attached either manually or automatically to most consumer containers.

Objects and Advantages

Accordingly, besides the objects and advantages of the reminder device described in my above patent, several objects and advantages of the present invention are;

a) to provide a device that can be used with a great number of containers having curved or flat surfaces;

b) to provide a device that encourages implementation through ease of assembly, application and use.

c) to provide a device that is inexpensive to produce using current manufacturing schemes.

d) to provide a device that remains operational for an extended period.

Further objects and advantages of my invention will become apparent from consideration of the drawings and ensuing description.

BRIEF DESCRIPTION OF THE DRAWINGS

FIG. 1 is a perspective view of a first preferred embodiment 100 of my invention. In this example, a dosage reminder device is shown on a release liner sheet forming part of a roll of the reminder devices. The device has been die cut on the liner and excess material (around the device) has been removed from the liner. The device can be removed from the liner and mounted on a container or other flat or curved surface.

FIG. 2 is an exploded perspective view of the device of FIG. 1 shown on a portion of a release liner that forms part of a roll of the reminder devices. Indicia are shown printed on the front surface of a major pressure sensitive sheet. The device has not yet been die cut and therefore no excess material has been removed from the liner.

FIG. 3 is a planar view of the front of the device of FIG. 1 as it appears after removal as a unit from the release liner. The extrusion profile is shown located on the outside or attached to the front viewing surface of the sheet.

FIG. 4 is a planar view of the back of the device of FIG. 3.

FIG. 5 is a planar view of the front of the device of FIG. 3 showing the customized schedule of the selectable member. The selector has been released or removed (not shown).

FIG. 6 is a planar view of the front of the selector or pointer after removal from the device of FIG. 3. The illustration shows how the selector is rotated (turned over) for fastening to the selectable schedule member.

FIG. 7 is a planar view of the front of the device of FIG. 3 showing the selector assembled (fastened to) or retentively interengaged with the selectable schedule member.

FIG. 40 is an end view of an interengaging complimentary single channel and single rib similar to those of the first embodiment 100.

FIG. 41 is a perspective view of a portion of a channel profile like that of FIG. 40 showing anti-displacement obstructions or détentes.

FIG. 42 is a perspective view of a portion of a rib profile like that of FIG. 40 showing an anti-displacement obstruction or détente.

FIG. 43 is a side cross-sectional view of a portion of a channel and a rib like those of FIG. 40 in which a plurality of engageable ridges and grooves serve as anti-displacement means.

FIG. 44 is a fragmentary front view of a rib retentively engaged in fragmented or sectioned channel.

FIG. 45 is a side cross-sectional view of a portion of a rib like that of FIG. 44 showing the tapered or angled ends which facilitate end entry into a channel segment.

FIG. 46 is an end cross sectional view of a channel and rib like those of FIG. 40 showing an alternate relative orientation of the cooperating complimentary profiles.

FIG. 56 is a cross sectional view showing the end of a segment of the selectable member of FIG. 52 and the end of the selector member of FIG. 54 positioned for retentive engagement assembly. Only a portion of the selectable member sheet and a portion the selector member sheet are shown FIG. 57 is a perspective view of the members of FIG. 56.

FIG. 58 is a view like that of FIG. 56 showing the progressive assembly of the members of FIG. 56.

FIG. 59 is a view like that of FIG. 56 showing the assembled members of FIG. 56.

FIG. 60 is a front view of embodiment 1100 of the invention wherein a multitude of selectable members are arranged on a strip and a multitude of selectors are arranged on a strip.

Reference Numerals in Drawings

| | | |
|---|---|---|
| 100 | Reminder Device | (FIGS. 1, 2, 3, 4, 7, 12, 13) |
| 102 | Selectable Member | (FIGS. 3, 4, 5, 7, 9, 10) |
| 104 | Selectable Member Position | (FIG. 3) |
| 106 | Selector Member | (FIGS. 3, 4, 6, 7, 9, 10) |
| 108 | Rib Profile (Male) | (FIGS. 2, 8, 8A, 11) |
| 110 | Channel Profile (Female) | (FIGS. 2, 8, 8A, 11) |
| 112 | Sheet Member (Intermediate) | (FIGS. 2, 8, 8A) |

-continued

Figure 20:
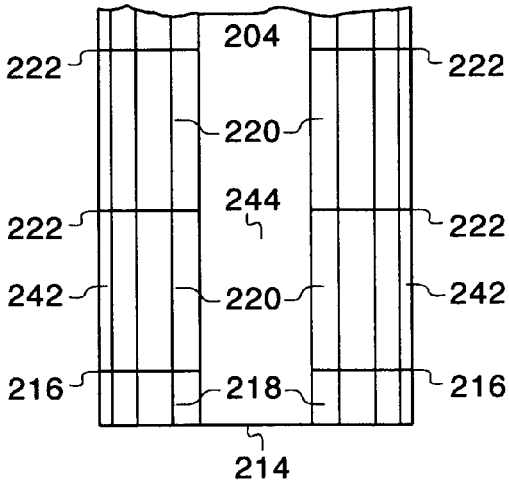
FIG. 20 is an enlarged fragmentary front view of the female profile of FIG. 17. Shown are the cut portions of the sidewalls producing stop elements.
Figure 23:
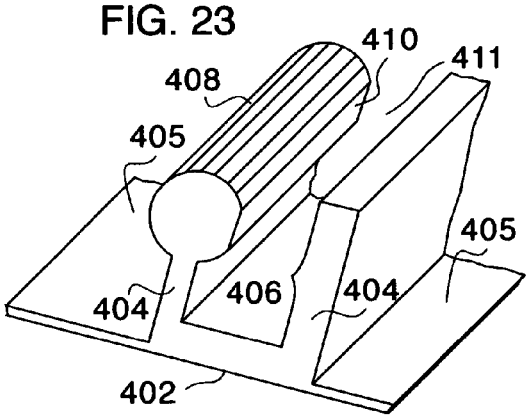
FIG. 23 is a fragmentary perspective view of a unitary profile, which is retentively interengageable with a duplicate profile. A member may be rotated or pivoted while interengaged to facilitate its sliding movement within the channel to a new selection, or to facilitate removal to a new selection.
Figure 24:
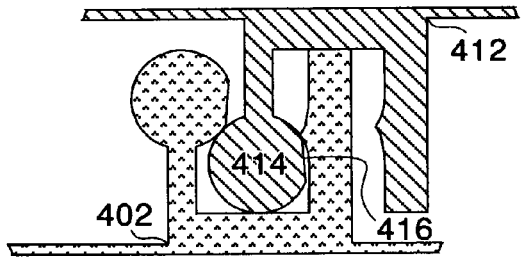
FIG. 24 is a cross-sectional view of the end of the unitary profile of FIG. 23 retentively interengaged with a duplicate profile, which is secured at a selected schedule position.

| Reference Numerals in Drawings | | |
|---|---|---|
| 114 | Sheet Member (Major) | (FIGS. 2, 8, 8A) |
| 115 | Release Liner | (FIG. 2) |
| 116 | Sheet Member Longitude | (FIG. 3) |
| 118 | Weakened Line | (FIG. 3) |
| 120 | Intermediate Assembly | (FIGS. 2, 8) |
| 122 | Complete Manufactured Assembly | (FIGS. 3, 8) |
| 124 | Front | (FIG. 3) |
| 126 | Back Surface | (FIG. 4) |
| 128 | Time Period Indicia | (FIG. 3) |
| 130 | Customization Area | (FIG. 3) |
| 131 | Marking | (FIG. 5) |
| 132 | Pointer Indicia | (FIG. 6) |
| 134 | Next Dose Indicia | (FIG. 6) |
| 136 | Pressure Sensitive Adhesive | (FIG. 4) |
| 138 | Pressure Sensitive Adhesive | (FIG. 4) |
| 140 | Retentive Engagement Portion | (FIG. 8) |
| 142 | Rib Base | (FIG. 8) |
| 144 | Channel Sidewall | (FIG. 8) |
| 146 | Channel Base | (FIG. 8) |
| 148 | Channel | (FIG. 8) |
| 149 | Channel Entry Opening | (FIGS. 8, 8A) |
| 150 | Stressed Portion | (FIG. 11) |
| 152 | Less Stressed Portion | (FIG. 11) |
| 154 | Longitudinal End | (FIG. 11) |
| 156 | Cut Upper Portion | (FIGS. 8, 11) |
| 158 | Longitudinal End Portion | (FIG. 11) |
| 160 | Prescription Label | (FIG. 12) |
| 162 | Exterior Wall Surface | (FIGS. 12, 13) |
| 164 | Vial | (FIGS. 12, 13) |
| 168 | Prescription Label | (FIG. 13) |
| 200 | Reminder Device | (FIG. 16) |
| 202 | Selectable Member | (FIGS. 14, 16) |
| 204 | Channel Member (Female) | (FIGS. 14, 17, 18, 19, 20) |
| 206 | Sheet Member | (FIG. 14) |
| 208 | Indicia | (FIG. 14) |
| 210 | Indicia | (FIG. 14) |
| 212 | Longitude | (FIG. 14) |
| 214 | Longitudinal End | (FIGS. 14, 20) |
| 216 | End Stop Cut | (FIGS. 14, 17, 20) |
| 218 | End Stop | (FIGS. 14, 20) |
| 220 | Selectable Position | (FIGS. 14, 20) |
| 222 | Stop Cut | (FIGS. 14, 20) |
| 224 | Selector Member | (FIGS. 15, 16) |
| 226 | Male Rib Member | (FIGS. 15, 17, 18, 19) |
| 228 | Sheet Member | (FIG. 15) |
| 232 | Indicia | (FIG. 15) |
| 234 | Indicia | (FIG. 15) |
| 235 | Viewing Surface | (FIG. 15) |
| 236 | Engagement Portion | (FIG. 17) |
| 238 | Collapsible Portion | (FIGS. 17, 19) |
| 240 | Base | (FIG. 17) |
| 242 | Sidewall | (FIGS. 17, 18, 19, 20) |
| 244 | Base | (FIGS. 17, 20) |
| 246 | Channel | (FIG. 17) |
| 248 | Channel Entry Opening | (FIG. 17) |
| 302 | Unitary Extrusion Profile | (FIGS. 21, 22) |
| 304 | Sidewall | (FIG. 21) |
| 306 | Channel | (FIG. 21) |
| 308 | Engagement Portion | (FIG. 21) |
| 310 | Collapsible Portion | (FIG. 21) |
| 312 | Base | (FIG. 21) |
| 314 | Channel Entry Opening | (FIG. 21) |
| 315 | Channel Entry Opening | (FIG. 21) |
| 316 | Unitary Extrusion Profile | (FIG. 22) |
| 402 | Unitary Extrusion Profile | (FIGS. 23, 24, 25, 26) |
| 404 | Sidewall | (FIG. 23) |
| 405 | Flanges | (FIG. 23) |
| 406 | Channel | (FIG. 23) |
| 408 | Engagement Portion | (FIG. 23) |
| 410 | Flat Portion | (FIG. 23) |
| 411 | Channel Entry Opening | (FIG. 23) |
| 412 | Unitary Extrusion Profile | (FIGS. 24, 25) |
| 414 | Engagement Portion | (FIGS. 24, 26) |
| 416 | Flat Portion | (FIGS. 24, 26) |
| 418 | Flanges | (FIG. 25) |
| 502 | Extrusion Profile | (FIGS. 27, 29, 30, 31, 32) |
| 504 | Selector | (FIGS. 28, 29, 30, 31, 32) |

-continued

Figure 36:
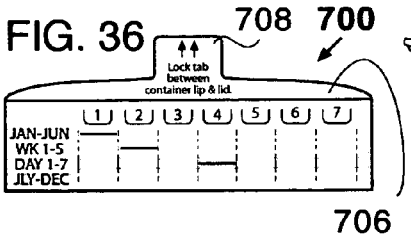
FIG. 36 is a planar view of the front of the reminder of FIG. 34 showing the tab extension.
Figure 39:
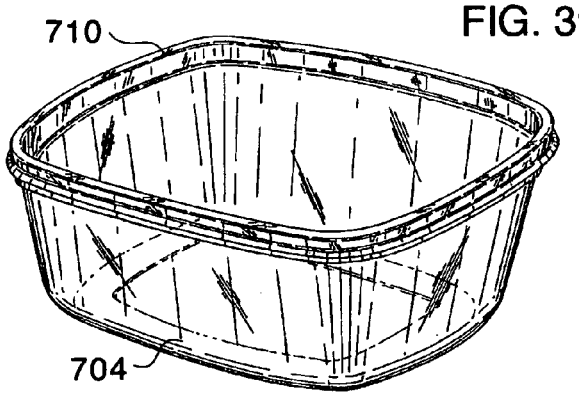
FIG. 39 is a perspective view of the container of FIG. 34.

| Reference Numerals in Drawings | | |
|---|---|---|
| 506 | Sidewall | (FIGS. 27, 31, 32) |
| 508 | Channel | (FIG. 27) |
| 510 | Top | (FIG. 27) |
| 511 | Channel Entry Opening | (FIG. 27) |
| 512 | Détente | (FIGS. 27, 29, 30, 31, 32) |
| 514 | Engagement Portion | (FIGS. 28, 29, 30, 31, 32) |
| 516 | Raised Area | (FIGS. 31, 32) |
| 518 | Stop Engagement Portion | (FIGS. 28, 30, 32) |
| 600 | Reminder Device | (FIG. 33) |
| 602 | Selectable Member | (FIG. 33) |
| 604 | Plastic Profile | (FIG. 33) |
| 606 | Sheet Member | (FIG. 33) |
| 608 | Indicia | (FIG. 33) |
| 610 | Indicia | (FIG. 33) |
| 612 | Selector | (FIG. 33) |
| 700 | Reminder Device | (FIGS. 34, 36) |
| 702 | Lid | (FIGS. 34, 35, 37, 38) |
| 704 | Container | (FIGS. 34, 35, 37, 39) |
| 706 | Sheet Member | (FIG. 36) |
| 708 | Tab | (FIGS. 36, 37) |
| 710 | Lip | (FIGS. 37, 39) |
| 802 | Channel Member | (FIG. 40) |
| 804 | Rib Member | (FIG. 40) |
| 806 | Channel Member | (FIGS. 41, 47) |
| 808 | Protrusion Détente | (FIGS. 41, 47) |
| 809 | Channel Entry Opening | (FIG. 41) |
| 810 | Rib Member | (FIG. 42) |
| 811 | Recess Détente | (FIG. 47) |
| 812 | Détente | (FIG. 42) |
| 814 | Channel Member | (FIG. 43) |
| 816 | Ridges And Grooves | (FIG. 43) |
| 818 | Rib Member | (FIG. 43) |
| 820 | Ridges And Grooves | (FIG. 43) |
| 822 | Channel | (FIG. 44) |
| 823 | Rib | (FIGS. 44, 45, 48) |
| 824 | Channel Structural Segment | (FIG. 44) |
| 826 | Channel Structural Segment | (FIG. 44) |
| 828 | Channel Structural Segment | (FIG. 44) |
| 830 | Segment End | (FIG. 44) |
| 832 | Segment End | (FIG. 44) |
| 834 | Rib End | (FIGS. 44, 45) |
| 836 | Rib End | (FIGS. 44, 45) |
| 838 | Leading Rib Portion | (FIG. 45) |
| 840 | Leading Rib Portion | (FIG. 45) |
| 842 | Channel Member | (FIG. 46) |
| 844 | Rib Member | (FIG. 46) |
| 902 | Finely Segmented Channel | (FIGS. 47, 48, 49, 50, 51) |
| 904 | Selectable Position | (FIG. 48) |
| 906 | Selectable Position | (FIG. 48) |
| 908 | Selectable Position | (FIG. 48) |
| 1000 | Reminder Device | (FIG. 55) |
| 1002 | Selectable Member | (FIGS. 52, 53, 55) |
| 1004 | Channel | (FIGS. 52, 56) |
| 1006 | Front Surface | (FIG. 52) |
| 1008 | Sheet | (FIGS. 52, 56, 57, 58, 59) |
| 1010 | Schedule Indicia | (FIG. 52) |
| 1012 | Customizing Indicia | (FIG. 52) |
| 1014 | Structural Segmenting | (FIG. 52) |
| 1016 | Channel Structural Segment | (FIGS. 52, 56, 57, 58, 59) |
| 1020 | Selector Member | (FIGS. 54, 55, 56, 57, 58, 59) |
| 1022 | Back Surface | (FIG. 53) |
| 1024 | Adhesive | (FIG. 53) |
| 1026 | Adhesive | (FIG. 53) |
| 1028 | Rib | (FIGS. 54, 56, 57, 58) |
| 1030 | Rib | (FIGS. 54, 56, 57, 58) |
| 1032 | First Surface | (FIG. 54) |
| 1034 | Sheet | (FIGS. 54, 56, 57, 58, 59) |
| 1036 | Indicia | (FIG. 54) |
| 1038 | Indicia | (FIG. 54) |
| 1040 | Viewing Surface | (FIGS. 54, 57) |
| 1050 | Rib | (FIGS. 56, 57, 58) |
| 1052 | Rib | (FIGS. 56, 57, 58) |
| 1054 | Base | (FIG. 56) |
| 1056 | Channel Entry Opening | (FIG. 56) |
| 1058 | Protrusion | (FIGS. 56, 59) |
| 1060 | Protrusion | (FIGS. 56, 59) |
| 1062 | Base | (FIG. 56) |

-continued

Figure 64:
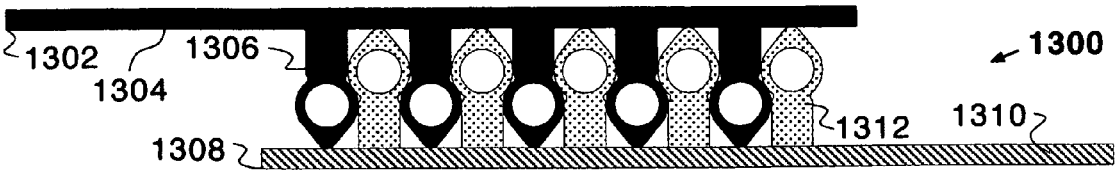
FIG. 64 is an end cross sectional view of the selectable member and an end view of the selector member of FIG. 63.
Figure 65:
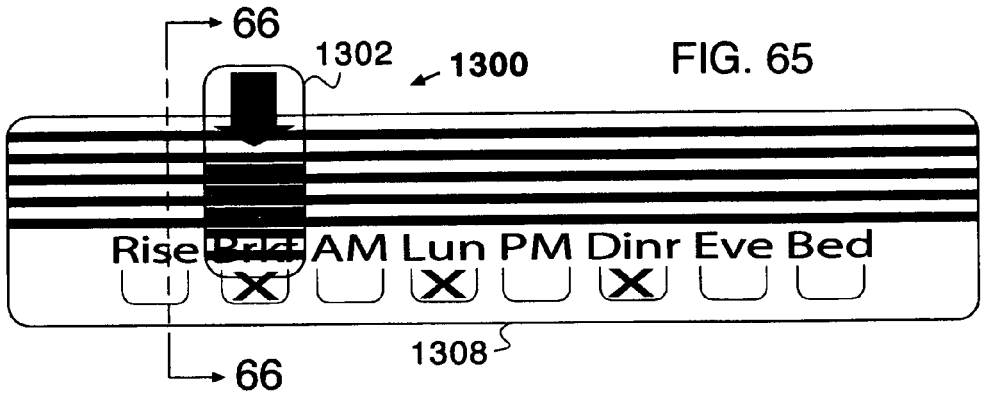
FIG. 65 is another front view of embodiment 1200 of the invention wherein a multitude of devices assembled from the members of FIG. 60 are arranged on a strip.
Figure 66:
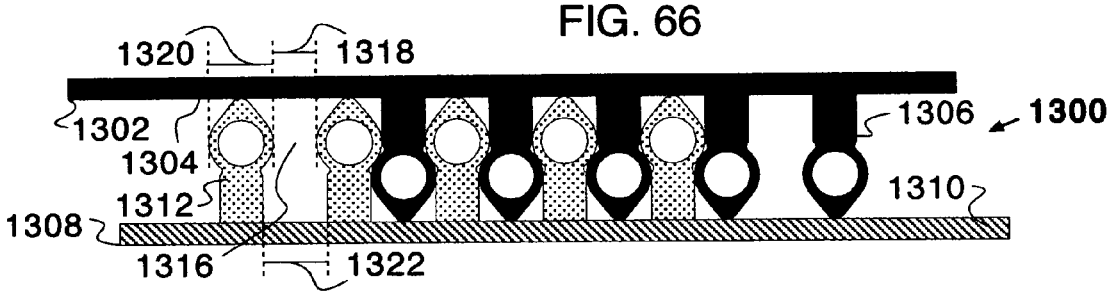
FIG. 66 is an end cross sectional view of the selectable member and an end view of the selector member of FIG. 65.

| Reference Numerals in Drawings | | |
|---|---|---|
| 1064 | Channel | (FIG. 56) |
| 1066 | Channel Entry Opening | (FIG. 56) |
| 1068 | Width | (FIG. 56) |
| 1070 | Width | (FIG. 56) |
| 1100 | Reminder Device | (FIG. 60) |
| 1102 | Selectable Members | (FIG. 60) |
| 1104 | Continuous Strip | (FIGS. 60, 61) |
| 1106 | Selector Members | (FIG. 60) |
| 1108 | Continuous Strip | (FIG. 60) |
| 1200 | Reminder Devices | (FIG. 61) |
| 1202 | Reminder Devices | (FIG. 61) |
| 1300 | Reminder Device | (FIGS. 62, 63, 64, 65, 66) |
| 1302 | Selector Member | (FIGS. 62, 63, 64, 65, 66) |
| 1304 | Sheet | (FIGS. 62, 64, 66) |
| 1306 | Ribs | (FIGS. 62, 64, 66) |
| 1308 | Selectable Member | (FIGS. 62, 63, 64, 65, 66) |
| 1310 | Sheet | (FIGS. 62, 64, 66) |
| 1312 | Ribs | (FIGS. 62, 64, 66) |
| 1314 | Indicia | (FIG. 62) |
| 1316 | Channel Entry Openings | (FIG. 66) |
| 1318 | Entry Opening Width | (FIG. 66) |
| 1320 | Rib Width | (FIG. 66) |
| 1322 | Channel Individual Width | (FIG. 66) |
| 1350 | Selector Member | (FIG. 67) |
| 1356 | Ribs | (FIG. 67) |
| 1400 | Reminder Device | (FIG. 68) |
| 1408 | Selectable Member | (FIG. 68) |
| 1410 | Sheet | (FIG. 68) |
| 1412 | Ribs | (FIG. 68) |
| 1450 | Selector Member | (FIG. 68) |
| 1456 | Ribs | (FIG. 68) |

DETAILED DESCRIPTION OF THE PREFERRED EMBODIMENT

With reference now to FIGS. 1 through 13, a first preferred embodiment of the reminder device is generally illustrated at 100. The reminder device includes two parts or selection members, a selectable support member 102 including a plurality of individually selectable positions 104, and a moveable selector member 106, which acts as an indicator or pointer for individually selecting or designating each one of the selectable positions. Material for manufacture of the selectable member and the selector member may include flexible sheet stock such as paper, cardboard, metal or plastic and may be punched, cut, or similarly manufactured. Material may be put up in rolls for convenience. More rigid material and material otherwise manufactured would also work in many applications. Material for producing extrusions, moldings and castings may also be included. Material may be transparent, translucent, or opaque and may include some degree of elasticity or elastomericity. More or less transparent, translucent or opaque material would also work in many applications. Preferably both the selectable member and the selector member include complimentary interengageable resiliently flexible or deformable plastic extruded profiles 108, 110 for retentively interengaging or interlocking with each other. Preferably these complimentary extrusions are irremovably attached to deformable transparent sheet members 112 and 114, the extrusions longitudinally traversing the entire length (longitude) 116 of the sheet members. Extrusions that traverse only a portion of the length can work equally well in some applications. In the exemplary illustrations, the contiguous selectable and selector members are produced in a continuous assembly from which the selector is removable or releasable by tearing along a weakened line or lines 118 (suitably produced, as are known in the art). Preferably the profile longitudes and the corresponding length of the selector member are shorter than the profile longitudes and the corresponding length of the selectable member. The weakened line preferably includes a structural perforation or structural perforations to facilitate release. The plastic extruded members may be produced integrally with the attached sheet member by extruding interengageable profiles along with the sheet. It should be noted that the complimentary extruded profiles may be formed unjoined directly to each other (completely separated) as shown, or may be formed directly joined (i.e. at their base) such that different portions of the directly joined extruded profiles exhibit the functional properties of extruded members that are not directly joined. Alternatively, the extrusion member or members (either directly joined or unjoined directly) may be produced independently (from the sheet member) and then attached to the sheet by any suitable method. A variety of attachment methods for alike, similar and disparate materials are well known in the art. For example, attachment means such as heat, chemical, welding, adhesive, etc. may be used as is suitable and appropriate for joining device components to each other or for attaching the device to an article.

Best seen in the exemplary illustration of FIG. 2, is a pair of preferably transparent mating or complementary interengeable extruded plastic profile members 108 and 110, which are preferably each of different color (ex. red polyethylene for one and blue polyethylene for the other). The spaced-apart generally parallel profiles are resiliently flexible or deformable and are separable after interengagement. The two extrusions 108 and 110 are separately formed and are preferably more or less concurrently attached by any suitable method (ex. heat) to the front or outside viewing surface of the intermediate deformable sheet member 112, which is preferably transparent (ex. clear polyethylene) to produce an intermediate assembly 120. The intermediate assembly is then attached by any suitable means known in the art (ex: heat, or adhesive) to the deformable preferably transparent major sheet member (ex. clear polyethylene film) 114 which is preferably capable of carrying indicating scheduling indicia preferably on a front viewing surface, to produce the complete manufactured assembly 122 shown in FIG. 3. Indicia (in addition to or in place of other indicia) may also be carried on the intermediate assembly sheet member if necessary. The major sheet member may be attached to an article support surface such as a container, a card, a notice board etc., prior to attachment or after attachment to the intermediate assembly. It should be noted that while attachment of extrusion members to an intermediate sheet member allows for convenience in device manufacture for some facilities, the presence of an intermediate sheet member is not strictly necessary to produce the invention. Either the intermediate sheet or the major sheet may be eliminated entirely so long as the plastic extruded profile members are attached to a sheet member. Regardless of whether the device includes either an intermediate sheet member or a major sheet member or both, it is of course possible to link the reminder device to an article such as for example, a carton or a bottle etc., by attaching the manufactured assembly (or further assembled device) to the article support surface using suitable means (ex. adhesive). It is anticipated that either one or both of the sheet members may include suitable coatings, or treatments or additional layers of material (ex: adhered laminates or co-extrusions) of the same or different kind to impart desirable characteristics for the manufacture or destined end use of the device. For example: a film laminate that can withstand higher temperatures, or provide a better oxygen barrier or deliver greater tear resistance. Another example is treatment to allow the device to be printed by a pharmacy printer or computer printer or other suitable printer. All sorts of plastics and papers and combinations of materials are possible. Although not limited to the following, a few of the possible printers in current use are a thermal printer, a laser printer, an ink jet printer or a dot matrix printer. Such coatings and laminates are readily commercially available to the converting and packaging industry. The support surface to which the device may be attached may carry appropriate indicia produced directly on or in the support surface by suitable means known in the art. Such indicia may be included for viewing through the attached reminder device.

FIGS. 3-6 show the front 124 and back surface 126 of the reminder device 100. In the exemplary illustrations, the indicating scheduling indicia on the selectable member consist of selectable time periods 128 for consumption of medication and corresponding areas 130 that may be inscribed by the user for regimen customization. The sheet member in the selectable member may be produced in any suitable size appropriate to the task at hand. The sheet member for example, may be of appropriate dimensions and carry additional indicia to function as a traditional product label or prescription label. Portions of the selectable member extrusion profile, corresponding to selectable positions 104, permanently reference the indicia so that a single portion is associated with a single time period. A customized dosage schedule is established, preferably after attachment of the device to an article, by marking or inscribing 131 the scheduling indicia by pen or marker or like means in accordance with prescription label instructions. Other marking means will also work in many applications. The selector 106 acts as a next dose pointer and is so indicated at 132 and 134 (FIG. 6). Indicia and color of indicia on the selector enhance visual perception of the selector as a pointer, but such markings (indicia and color of indicia) of the selector are not strictly necessary for correct operation of the device, so long as selections made by the selector are perceptible as such. For example, location of the selector on a different visual or tactile plane from the selectable member may be sufficient for perception of a selected position and can be equivalent in function to cooperating indicia. Preferably, as is seen in the present embodiment, the raised channel remains uncovered in areas outside that selected (the selected position) by the selector, enhancing tactile and visual differentiation between selected and unselected positions. It will now become obvious to those skilled in the art that a device of the present invention may be produced with a selector that does not include a sheet, as the profile alone (ex. rib or channel) can be sufficient. Preferably the indicia are produced by flexographic process on the front of the device (preferably on the major sheet member) prior to sheet assembly with any profiles, but indicia produced after assembly or produced on the back of a sheet member will also work in many applications. Other suitable printing or marking methods may be used successfully. While a transparent sheet member is preferred, a non-transparent sheet member will also work in many applications. For example, where occlusion of underlying information is not a concern or where indicia are produced directly on prescription or product labels that form part of the major sheet member. The reminder device as illustrated is adherable. As seen in FIG. 4, portions of a back surface 126 of the major sheet member 114 of the selectable member 102 retain a coating of pressure sensitive adhesive 136 and 138 for attaching the device to an article. Those skilled in the art will recognize that other means of adhering could be readily employed (ex. static cling, surface tension, suction, magnetic etc.) and work well in some applications. The adhesive is preferably transparent and is pattern or zone applied or distributed, by a process well known in the art, to exclude the removable or releasable selector portion 106. With some sheet materials, it may be advantageous to pattern distribute the adhesive on the back of the selectable member to facilitate handling and application to an article. Any suitable method known in the art will suffice. For example the adhesive may be pattern applied, applied overall and pattern deadened, or the liner die cut such that portions of the liner remain adhered to the selectable member in a pattern when the selectable member is peeled from the liner sheet. The pressure sensitive adhesive serves to attach the device to an article. Processing of pressure sensitive sheet materials and pressure sensitive sheet material attached to other members to produce a device shape as shown in FIG. 3, is well established in the art. In a preferred method, the device or a plurality of devices is produced on an oversized pressure-sensitive adhesive-backed sheet held on a roll of release carrier or release liner sheet 115 by the pressure sensitive adhesive. The liner permits facilitated removal of the device when desired. The device shape (and any perforations) is cut (ex. kiss die cut) in the oversized pressure sensitive sheet or oversized device, producing the device seen in FIG. 3. The device is left on the release liner until required for application to an article. As best seen in FIG. 1, the excess pressure-sensitive sheet portion (outside the device) is preferably removed from the liner and the device(s) is rolled up with the now oversized liner 115. The excess pressure-sensitive sheet portion may be left on the liner and still work in some applications (ex. manual application of the device). In preferred application practice, the entire manufactured device assembly 122 as shown in FIG. 3 is removed as a unit from the release liner by peeling and adhering or mounting as a unit to the outside of a labeled or unlabeled container or other suitable article. Such application leaves the selectable extrusion profile directly accessible, being attached to the front or outside surface of the selectable sheet member. While application may be performed manually, preferable automated application is possible from a roll of reminders or stacked pile of reminders as is known in the application art (particularly for labels) by way of labeling equipment in current common use (may require some adaptation). If desired, the selectable member 102 alone however, may be separately removed from the liner and adhered or mounted. Activation of the exemplary device is accomplished preferably after mounting by assembling the selector 106 with the selectable member (fastening the selector to the selectable member) 102. The selector 106 is removed from the manufactured assembly 122 (FIG. 5) by tearing along the structural perforation lines 118.

Turning to FIGS. 6,7, 9 and 10, the selector is suitably rotated or turned over (FIG. 6) and superimposed over an appropriate schedule portion (FIGS. 7 and 9) of the selectable member such that the appropriate mating or complimentary interengageable members of the selector and the interengageable members of the selectable member face each other and are suitably aligned for subsequent retentive engagement or interlocking. Indicia on the selector is produced in such a manner that rotation (turning over) of the selector from the presented orientation in the manufactured uninterengaged reminder device 100 in FIG. 3 to the final selector orientation shown in FIG. 6 orients the selector indicia for legible proper operation of the device 100. Sufficient pressure is then applied (ex. digitally) to the back of the selector (now the outermost surface) in the areas of the aligned interengageable extrusion members to press the selector onto and into the selectable member (large arrows in FIG. 9) until the interengageable members of the selector securely interengage (or snap together) with the interengageable members of the selectable member to the position shown in FIG. 10. Preferably the selector is thusly snappingly engaged with the selectable member. Preferably the snapping engagement provides sensory tactile and audible feedback to the user to signal successful retentive engagement. This procedure can be used to retentively interengage the selector with the selectable member at a plurality of positions located approximately anywhere along the longitude of the plastic extrusion of the selectable member. It should be noted that flexibility of the members allow that engagement of all the profiles be accomplished concurrently, approximately concurrently or at separate times. Pressure and friction at the mated portions of the plastic profiles securely hold the interengaged selector at a selected position. The channel member material disposed proximate to a channel-longitude entry opening provides barrier or obstructing means now restricting rib member egress from the channels. A user can move the selector to a new selection position by pulling up on a suitable portion of the selector (ex. the sheet member) to disengage the interengaged members (i.e. separating the selector from the selectable member) and repeating the interenging procedure at a new position. Otherwise and preferably, a user can suitably grasp or suitably engage (ex. thumb and fingernail on selector side edge) the interengaged selector and forcefully slide the selector sideways along the longitude of the selectable member extrusion profile, as indicated by the multi-headed direction arrows in FIG. 7, while retentively engaged, to make a new selection at an adjacent or other position (described below).

Figure 8:
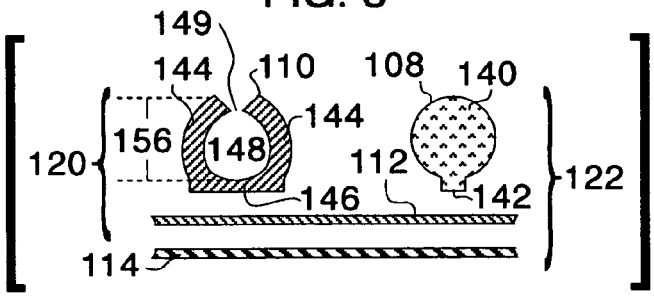
FIG. 8 is an enlarged exploded cross-sectional view of the end of the device of FIG. 3 showing the retentively interengageable male (rib) and female (channel) profiles prior to any engagement.
Figure 8A:
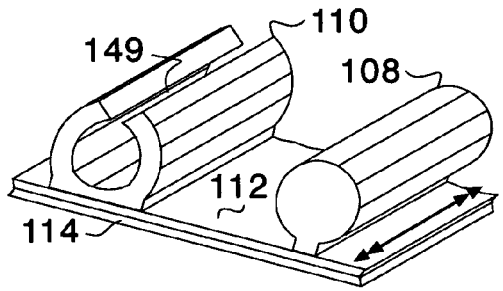
FIG. 8A is an enlarged fragmentary perspective view of FIG. 3 showing the retentively interengageable male (rib) and female (channel) profiles prior to any engagement.

FIGS. 8-11 illustrate the interenging extruded members and operation of the device in greater detail. Generally what are depicted are a deformable sheet member defining a channel for retentive engagement and a sheet member defining a rib adapted to receive retentive engagement in said channel. The channel further serves as a pathway for engageably sliding the rib member to each of an array of selectable positions. FIG. 8 shows an enlarged exploded cross-sectional end view of the device of FIG. 3. Illustrated are the two mating or complimentary, generally parallel plastic profiles protruding from the front of the assembly, the plastic profiles being shown as the first male profile 108 and the second female profile 110. The male extruded profile appears as a filled bulbous rib including a generally circular (in end cross-section) bulbous engagement portion 140 integrally attached to a base 142. The female extruded profile includes a slotted channel or open-ended groove formed by a pair of curved engagement sidewalls (curved ribs) 144 integrally attached to a common base 146. The channel base 146 and the rib base 142 are attached to the common intermediate sheet 112, forming the intermediate assembly 120. The intermediate sheet of the intermediate assembly is in turn attached to the major sheet 114, producing the complete manufactured assembly 122 of the device 100. The female channel profile may be otherwise described as a longitudinal channel 148 defined between a first longitudinal end and a second longitudinal end and including a channel entry opening 149 along said channel longitude, which is narrower than the channel 148 itself, the channel-longitude entry opening restrictably providing entry into the channel. Channel member material disposed proximate to said channel entry opening provides barrier or obstructing means normally restricting access to the channel. The formed channel 148 is somewhat circular in end cross-section. Excluding the common base, the sidewalls are otherwise unjoined and are tapered or angled at the front such that their front surfaces at the opening along the longitude of the female profile guide access to the channel. Physical characteristics (ex. shape, deformability, elasticity, etc.) adapt the male and female extrusions to retentively and securely interengage with each other when the engageable portion of the male rib profile is seated in the channel formed by the female profile. In normal undeformed or normal unstressed channel member condition, the channel entry opening 149 is too narrow or too small to permit entry (for retentive engagement) of the retentive engagement portion 140 of the selector rib, and the channel 148 is too small to contain the retentive engagement portion 140. Entry and containment are only possible by first outwardly resiliently deforming or flexing the female extrusion sidewalls to expand the channel entry opening and expand the channel.

Figure 9:
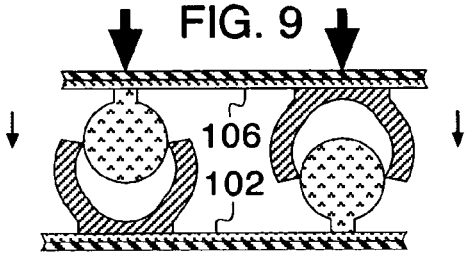
FIG. 9 is an enlarged cross-sectional view of the end of the selectable member of FIG. 5 and the selector member of FIG. 6. Shown is the selectable schedule member in process of interengaging with the superimposed selector.

FIG. 9 shows the profiles in the selector correctly oriented and aligned for initial engagement and for subsequent secure engagement, and shows them being pressed onto and into the selectable member profiles to outwardly deform the female channel extrusion sidewalls, expanding the channel entry opening and the channel. As previously indicated a removable or releasable portion of the manufactured assembly 122 is released to form the selector 106 in the reminder device 100.

Figure 10:
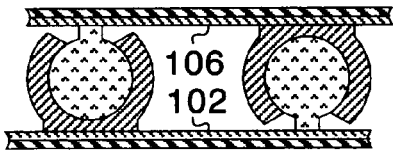
FIG. 10 is an enlarged cross-sectional view of the end of FIG. 7. Shown is the selectable schedule member retentively interengaged with the superimposed selector member.

FIG. 10 shows the selector interengaged and securely held by the still partially outwardly deformed (i.e. stressed) sidewalls of the female channel extrusions. It should be noted that the interengaged male rib extrusions remain under constant pressure from the female extrusion sidewalls because of inherent memory in the deformed material attempting to return the sidewalls to their unstressed state, the condition serving as anti-displacement means including ant-sliding means. Interengaging the male profile of the selector with the female profile of the selectable member is sufficient to reliably secure the selector at a chosen position and prevent inadvertent dislocation of the selector. Interengaging the remaining respective complimentary profile members provides an additional level of security interengaged profiles that are less securely held will also work in many applications. Such extra security is not necessary for many applications and a device of the present invention may be produced with only a single female and only a single complimentary male profile.

Figure 11:
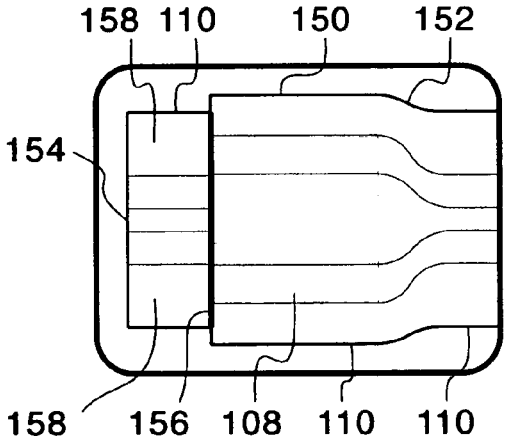
FIG. 11 is a greatly enlarged, fragmentary, front view of the assembled device of FIG. 7. A longitudinal end portion of the selectable member channel profile has been cut to create a stop, hindering inadvertent longitudinal or sideways displacement of the retentively interengaged selector. The attached sheet members have been omitted from the illustration for clarity.

FIG. 11 is an enlarged fragmentary front view of the device showing the male extruded rib member 108 (shaded area) from the selector retentively interengaged with the female extruded channel member 110 from the selectable member. The sheets in the device are not shown for clarity. It can be seen that several anti-displacement means act to secure the interengaged selector at a selected position. The shape and constant pressure from the deformed or stressed female channel extrusion portion 150 around the retained male extrusion hinders inadvertent movement of the selector in all directions. Sideways or sliding movement of the male profile within the female channel along the longitude of the female extrusion is further hindered by the slightly stressed (less stressed or less deformed) female extrusion portion 152 shown adjacent to the right end of the interengaged male extrusion. While these antidisplacement means are sufficient to prevent inadvertent dislocation of the selector in most instances, forceful sideways movement of the selector by a user changing selector positions could inadvertently slide the selector extrusion out the open longitudinal end 154 of an unaltered female profile. FIG. 11 also shows a further antidisplacement enhancement to counteract such an occurrence. As seen in FIGS. 8 and 11, dividing or structurally segmenting the channel profile by preferably cutting an upper portion 156 (i.e. portion of the side walls 144) of the profile near the end of the selectable member channel allows independent deformation of at least a portion of the end portion. Stated otherwise, adjacent or proximate portions of the channel extrusion profile are now independently deformable. As a result, the adjacent interengaged selector leaves a portion of the end portion (of the selectable member) in normal unstressed (undeformed) condition and the corresponding portions of the channel again too small to contain the selector or too narrow to permit entry (both from the open end and at the channel entry opening along the channel longitude) of the rib extrusion 108. The sidewalls of the longitudinal channel end portion 158 are not caused to outwardly deform when reached by sideways movement of an adjacent selector in the channel pathway, effectively stopping the selector from inadvertently moving out of the open end of the female profile. It is noteworthy that the channel entry opening 149 which restricts entry of the rib into the channel along the channel longitude, also contributes to restricting entry of the rib into the channel via the channel open end by interfering with entry of a portion of the rib locating in the channel entry opening. Those skilled in the art will also readily adapt other means for preventing inadvertent dislocation of the selector (ex. heat sealing or crushing a portion of the selectable profile to narrow or close an opening or open end). Those skilled in the art will recognize that cutting of a profile as described (and crushing or sealing) may be concurrently or approximately concurrently performed with the die cutting operation preferably used to produce the final shape of the device as shown in FIGS. 1 and 3.

Figure 12:
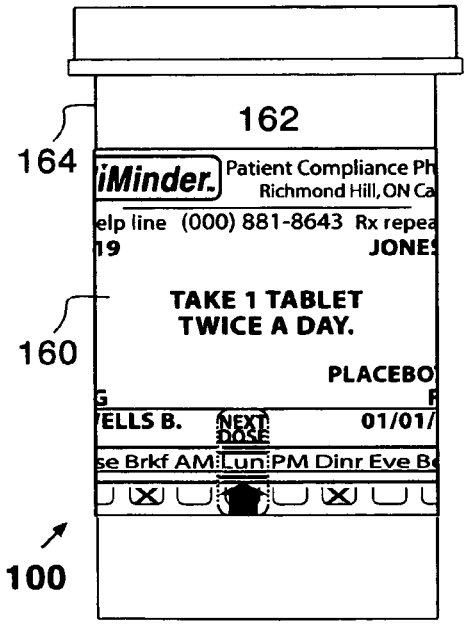
FIG. 12 illustrates the device of FIG. 7 as it appears when adhered over a prescription label on the exterior wall of a vial. The longitude of the device is shown conforming to the curved wall of the container.

FIG. 12 shows the reminder device 100 longitudinally adhered in horizontal orientation (relative to the container) over a prescription label 160 located on the exterior wall surface 162 of a vial 164. The device longitude is shown deforming to conform to the curved wall of the container.

Figure 13:
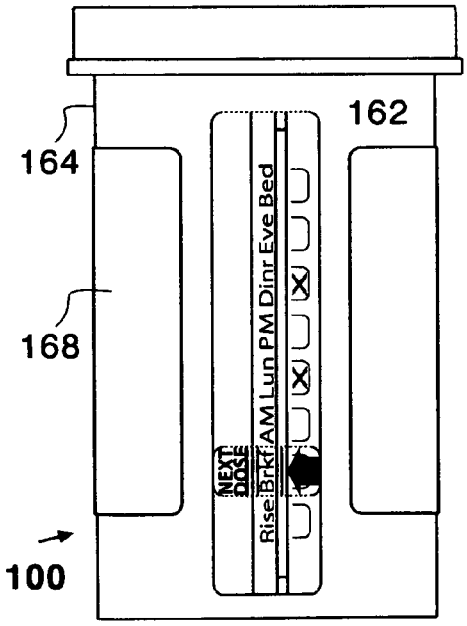
FIG. 13 shows the device of FIG. 7 as it appears when adhered to the exterior wall of a vial. The longitude of the device is positioned more or less parallel to the vertical axis of the container. The width of the device is shown conforming to the curved wall of the container.
Figure 14:
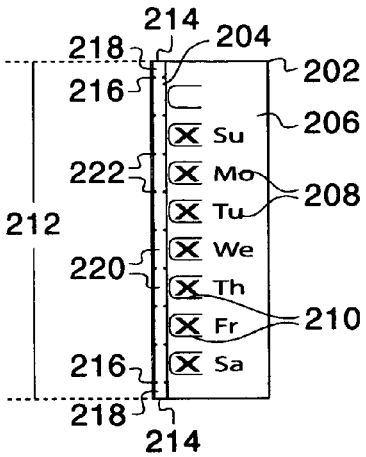
FIG. 14 is a planar view of the front of the selectable member of the device of FIG. 16.

FIG. 13 shows the reminder device 100 longitudinally adhered in vertical orientation (relative to the container) to the exterior wall surface 162 of the vial 164 which includes a prescription label 168. The device width is shown deforming to conform to the curved wall of the container. It should be noted that it is possible to advantageously produce a single device according to the present invention in which the longitude can deform to adequately conform to great ranges in the radius of curvature. And it is possible to advantageously produce a single device according to the present invention in which the width can deform to adequately conform to great ranges in the radius of curvature. Preferably construction permits the single device to conform to a radius of curvature between one approaching infinity and one less than 14 mm. It should be noted that such deformability is not strictly necessary to produce the device and a device having the ability to conform to a radius of curvature of say less than 40 mm, or a larger radius of curvature could be adequate for many applications. It is also to be considered that the device mounting locations and orientations shown in FIGS. 12 and 13, while aesthetically pleasing and suitable due to space considerations, are not strictly necessary for correct operation of the device. For some applications the device could be mounted in a different orientation, attached to a different location (ex. the lid) or only be affixed by a portion of the back surface of the device.

To operate one of the mounted devices, when medication is taken, typically the user lifts the channel (female) profile of the selector to disengage it from the rib (male) profile of the selectable member, slides the selector (rib of selector still retentively interengaged with channel of selectable member) to align the next dose pointer with the inscribed next dosage time period on the selectable member, and retentively re-engages the disengaged profiles. The next dose pointer and the inscribed time period indicia form a reminder indicating when the next dose is due or when the last dose was taken.

It is of course possible to produce a device not having any preprinted schedule and attach the device to a pharmacy label for processing by the pharmacy. The pharmacy could then produce a suitable customized schedule array by suitable means (ex. pharmacy printer) at time of dispensing. It is also possible that a transparent device without any preprinted schedule could find use in other applications. Such a device, for example, could be applied over a standard pharmacy label on which a suitable customized schedule array is produced by the pharmacy.

Figure 15:
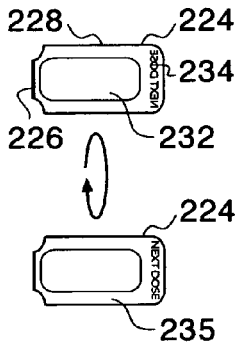
FIG. 15 is a planar view of the front and back of the selector of the device of FIG. 16. The illustration shows how the selector is rotated (turned over) for fastening to the selectable member.
Figure 16:
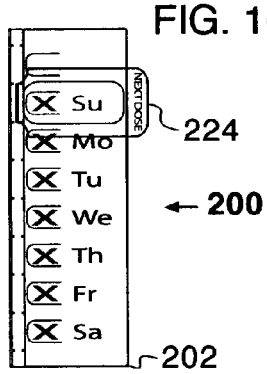
FIG. 16 is a planar view of a second embodiment 200 of my invention. In this example, the selector pointer is shown retentively interengaged at a selected position on the front of the selectable schedule member.
Figure 17:
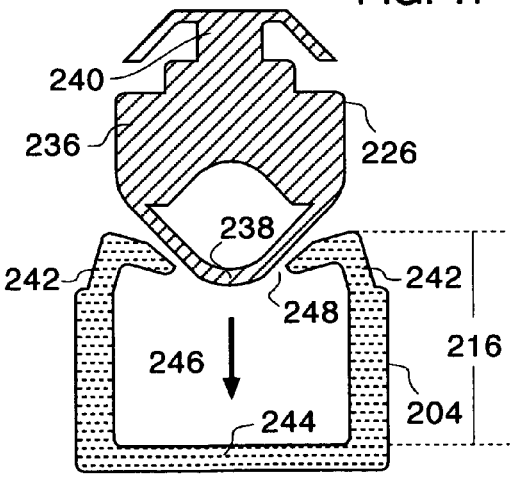
FIG. 17 is an enlarged cross-sectional view of the end of the male rib and female channel extruded profiles in the device of FIG. 16 prior to interengaged assembly.

With reference now to FIGS. 14 through 20, a second embodiment of the reminder device is generally illustrated at 200. A selectable support channel member 202 in the present embodiment includes a single female extrude plastic profile 204 forming a channel, which is retentively interengageable, attached by suitable means to a transparent deformable sheet member (ex. a thin transparent or translucent sheet) 206 carrying suitable indicia 208 and 210. The profile is resiliently flexible or deformable and protrudes from the front surface of the sheet member and longitudinally 212 traverses approximately the entire longitude of the sheet structure. A portion of the channel profile near each opposing open longitudinal end 214 of the profile is cut 216 as in the first preferred embodiment 100 to produce independently deformable (from adjacent or proximate portions of the channel profile) stop elements, obstructions, or détentes 218. Indicia, as in the case of the first preferred embodiment 100, correspond to fixed dedicated individually selectable positions 220 on the extrusion. The profile is further cut 222 (similarly to the end stop cuts) between each of the selectable positions such that adjacent portions of the profile, those being on either side of the cut, are independently deformable and effectively act as stops. A moveable selector member 224 in the present embodiment of the invention, reminder device 200 includes a single male retentively interengageable plastic extruded profile 226 or rib (complimentary to the female profile) which is resiliently flexible or deformable and is attached by suitable means to a transparent deformable sheet member 228 carrying suitable indicia. The selectable member and the selector may be produced on a common sheet member and then detached and operationally assembled or interengaged to configure the reminder 100 to the arrangement shown in FIG. 3, or produced independently on separate sheet members for operational assembly or interengagement. The resiliently flexible or deformable selector extrusion profile also protrudes from a surface of the selector sheet member and is shown with its longitude positioned along the vertical orientation (relative to illustration page) of the sheet structure in FIG. 15. The selector 224 acts as a next-dose pointer and is so indicated by the indicia having light shading at 232 and characters at 234 (FIG. 15). As shown in FIGS. 15-18, the selector indicator is suitably rotated or turned over (FIG. 15) and superimposed over an appropriate schedule portion (FIG. 16) of the selectable member such that the interengageable member (male profile) of the selector and the interengageable member (female profile) of the selectable member face each other and are suitably aligned at a channel-longitude entry opening 248 (FIG. 17), located along the longitude 212 of the channel, for subsequent retentive engagement or interlocking. As can be seen in FIG. 17, the channel-longitude entry opening 248 is narrower or smaller than (smaller than the distance in the channel between opposing sidewalls) the channel 246 and is also narrower or smaller than (smaller than the rib dimension between said channel walls in the operationally assembled or interengaged device) the selector rib 226. Channel member material disposed proximate to said channel entry opening provides barrier or obstructing means normally restricting access to the channel. The channel-longitude entry opening 248 normally restricts entry of the selector rib 226 into the channel and only a portion of the selector rib is able to enter the channel by way of crossing the channel entry opening without deforming the channel curved sidewalls (curved ribs) 242 to expand the channel entry opening (and to expand the channel). As can be seen in FIG. 17, the sidewalls are tapered or angled at the front such that their front surfaces at the opening 248 along the longitude of the female profile guide access to the channel. Selector indicia is produced in a manner such that reorientation of the selector shown in FIG. 15 from the presented orientation in the manufactured uninterengaged device to the final selector orientation (in the interengaged device) presents the selector indicia for legible proper operation of the device 200. The indicia are thusly viewable at a viewing surface 235 (e.g. indicia viewable on, in or through the viewing surface). Sufficient pressure is then applied (ex. digitally) to the viewing surface of the selector in the area of the aligned interengageable extruded profile members to press the selector onto and into the selectable member until the interengageable member of the selector securely interengages (or snaps together) with the interengageable member of the selectable member to the position shown in FIG. 18. The channel member material disposed proximate to said channel entry opening provides barrier or obstructing means now restricting rib member egress from the channel.

FIGS. 17-20 show the extruded profile members in the device 200 in greater detail. The attached sheets are not shown for simplicity.

FIG. 17 illustrates an enlarged end cross-sectional view of the retentively engageable profiles in the device. The male extruded profile (rib member) 226 includes a bulbous retentive engagement portion 236 including a reversibly collapsible or resiliently deformable portion 238 and an integrally attached base 240. The collapsible portion allows for controlled movement of the profile when the extruded profile is interengaged and allows for temporary change in the outside dimensions of the profile (and volume occupied by the profile) under different stress conditions. The female extruded profile (channel member) 204 includes a pair of deformable engagement sidewalls 242 formed from ribs and integrally attached to common base 244. The sidewalls and the base of the female extrusion form a somewhat rectangular slotted channel or open-ended groove 246. The sidewalls are otherwise unjoined and are tapered at the top to guide access to the channel along the length of the profile. The female profile may be otherwise described as a longitudinal channel 246 defined between a first longitudinal end and a second longitudinal end and including a channel entry opening (channel-longitude entry opening) 248 along said channel longitude. Physical characteristics (ex. shape, deformability, elasticity, etc.) adapt the male and female extrusions to retentively and securely interengage with each other when the retentively engageable portion of the male profile (retentively engageable portion of the rib) is retentively engaged in the channel formed by the female profile. With both the male and female profiles in normal unstressed condition (undeformed) FIG. 17, the channel entry opening 248 and the female channel 246 are too small to allow undeformable entry of the larger retentive engagement portion 236 of the male extrusion at the channel entry opening 248. The channel is also normally too small or narrow to permit undeformed entry at the open longitudinal end 214 or channel-end entry opening. The longitudinal channel entry opening 248 therefore restricts the rib from entry into the channel via either the channel-longitudinal entry opening 248 by obstructing the engagement portions 236 and 238 or entry via the channel-end entry opening by obstructing entry of a portion of the rib locating in the channel entry opening (the portion between the base 240 and the portion locating in the channel). Preferable entry is possible by first outwardly deforming or outwardly flexing the female extrusion channel sidewalls 242. Following a procedure like that of the first preferred embodiment, the male profile is interengaged with the female profile by moving the male profile from the position shown in FIG. 17 to the position shown in FIG. 18.

Figure 18:
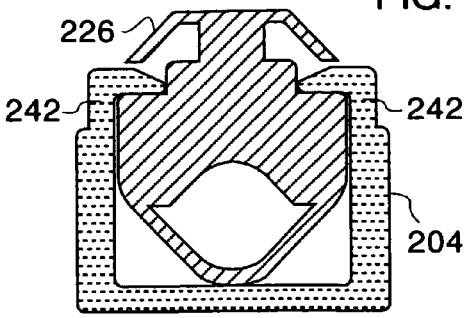
FIG. 18 is an enlarged cross-sectional view of the end of the male rib and female channel extruded profiles in the device of FIG. 16 after interengaged assembly.
Figure 19:
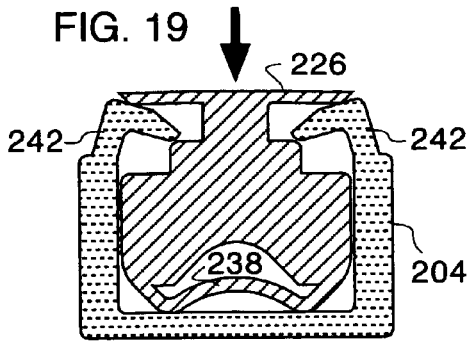
FIG. 19 is an enlarged cross-sectional view of the end of the male rib and female channel extruded profiles in the device of FIG. 16 after interengaged assembly. The male profile is shown collapsed for movement to a new selectable position.

FIG. 18 shows the female profile sidewalls 242 outwardly resiliently deformed (the channel resiliently expanded), which is the stressed position for the sidewalls when the extrusion members in the device are retentively interengaged with each other (i.e. the selection is secure). Stated otherwise, the interengaged male rib extrusion remains under constant pressure from the female extrusion sidewalls because of inherent memory in the deformed material attempting to return the sidewalls to their unstressed state, the condition serving as anti-displacement means. The channel member material disposed proximate to the channel-longitude entry opening provides barrier or obstructing means now restricting rib member egress from the channel. Retentively interenging the male profile of the selector with the female profile of the selectable member is sufficient to reliably secure the selector at a chosen position and prevent inadvertent dislocation of the selector. Since portions of the female extrusion, which are adjacent to the interengaged portion are independently deformable and they are not presently deformed (i.e. they are in the condition shown in FIG. 17), they do not permit sideways entry of the male profile (from the adjacent portion of the profile) when the male profile is in the condition shown in FIG. 18. It is however possible for the male profile to slidingly enter the undeformed female profile sideways if the interengaged male profile is first collapsed (FIG. 19) and then moved sideways within the channel into the adjacent portion of the female profile. With the exception of the procedure for changing a selected position, operation of the device in the present embodiment is the same as in the first preferred embodiment 100. To make a next-dose selection in the present embodiment, a user pushes down on the male extrusion in the area (the viewing surface) shown by the arrow in FIG. 19 with sufficient force to temporarily collapse the male extrusion, then slides the male extrusion to the desired position, and then releases the extrusion. The male and female extrusions automatically return to the uncollapsed state shown in FIG. 18 and the selection is again secure. The selection procedure may be accomplished by using only a single digit to contact the movable selector.

Figure 21:
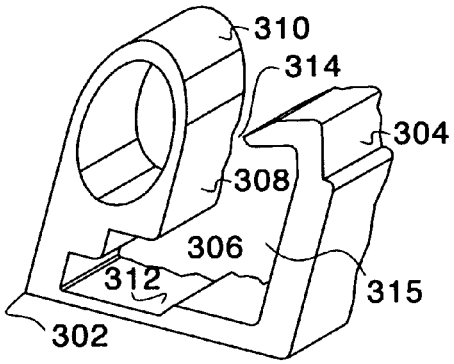
FIG. 21 is a fragmentary perspective view of a unitary profile, which is retentively interengageable with a profile like itself (a duplicate). A portion of the profile is reversibly collapsible or reversibly compressible.
Figure 22:
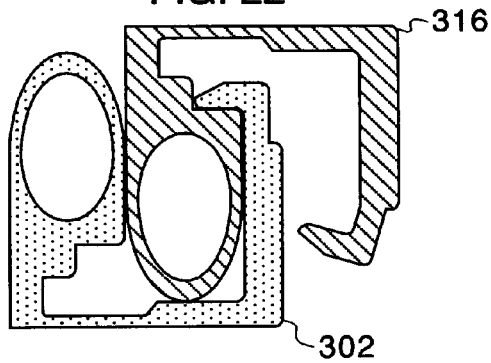
FIG. 22 is a cross-sectional view of the end of the unitary profile of FIG. 21 interengaged with a like profile (a duplicate).

FIGS. 21-22 illustrate a unitary plastic extruded profile 302 which is retentively interengageable with a duplicate profile of either the same or different longitude. A portion of the unitary profile may be released from a continuous arrangement (in similar fashion to embodiment 100) to provide the duplicate. This unitary extrusion construction can provide for manufacturing economies and desirable product design for some applications. The unitary extruded profile 302 is resiliently flexible or deformable and includes a deformable sidewall 304, a somewhat rectangular slotted channel 306, a bulbous engagement portion 308, a reversibly collapsible portion 310, a base 312 and a channel-longitude entry opening 314. Entry into the channel (for retentive engagement) by the duplicate is possible via the channel-longitude entry opening as in the previous embodiment. Entry into the channel (for retentive engagement) is also possible via a channel-end entry opening 315 (or channel-segment-end entry opening) as in the previous embodiment. The complimentary profiles are therefore retentively interengageable by deforming at least one or both of the profiles. The profile 302 may be cut in similar fashion to the female profile in the second embodiment to produce stops for a retentively interengaged profile. As can be seen in FIG. 22, a device having a selectable member including the unitary profile 302 and a retentively interengaged selector including a unitary profile 316 (duplicate of 302) can operate in the same fashion as the device in the second embodiment 200.

Figure 25:
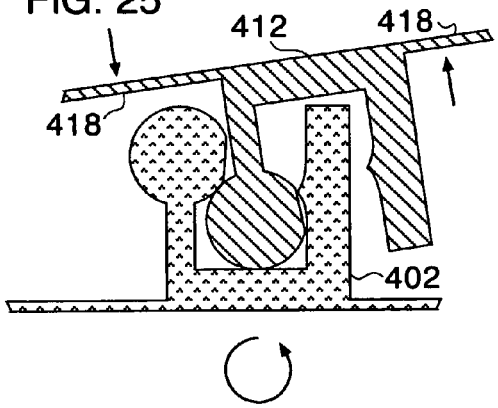
FIG. 25 is a cross-sectional view of the end of the retentively interengaged profiles of FIG. 24 showing the selector extrusion profile tilted (i.e. rotated) to facilitate movement within the profile channel.

FIGS. 23-26 illustrate another resiliently deformable unitary plastic extruded profile 402 which is retentively interengageable with a duplicate profile of either the same or different longitude. The unitary extruded profile includes deformable sidewalls or ribs 404, flanges 405 at the base of the sidewalls and a somewhat rectangular slotted channel 406. One of the ribs includes a bulbous somewhat circular (in end cross-section) bulbous retentive engagement portion 408. The flanges serve to facilitate handling and manipulation of the profile. The retentive engagement portion includes a flattened surface portion 410. A channel entry opening 411 is also included. Depending on orientation of the engagement portion, the engagement portion can fit loosely or tightly within the channel. A device having a selectable member including the unitary profile 402 and a selector including a unitary profile 412 (duplicate of 402) is securely (tightly) interengaged in the position shown in FIG. 24. Inadvertent movement of the selector is greatly hindered by the contacting surfaces (friction) and material memory (pressure) of the interengaged profiles acting as anti-displacement means including anti-sliding means, anti-rotation means and anti-pivoting means. Moving the selector to a new position within the channel is facilitated and accomplished by first tilting, pivoting or rotating the selector profile as shown in FIG. 25, sliding the selector while still interengaged within the channel to the new position, and then rotating back the selector to the position shown in FIG. 24.

Figure 26:
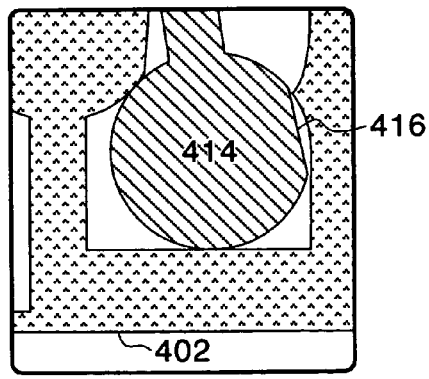
FIG. 26 is an enlarged cross-sectional view of FIG. 25 showing greater detail.
Figure 27:
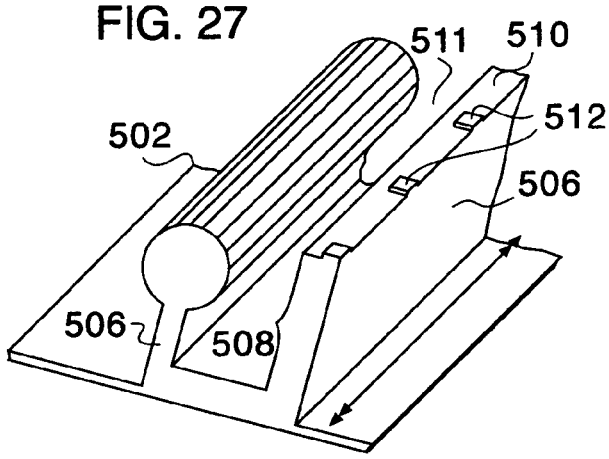
FIG. 27 is a fragmentary perspective view of an interengageable extruded profile of a selectable member. A sidewall (rib) of the extrusion channel includes anti-displacement stop elements.
Figure 28:
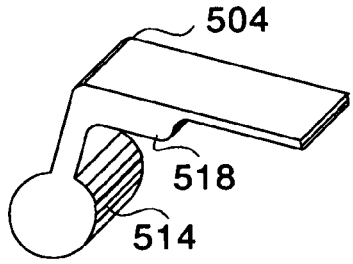
FIG. 28 is a perspective view of a selector interengageable with the profile of FIG. 27.

As best seen in FIG. 26, rotation of the selector profile 412 within the selectable member channel 406 alters the relative position in the channel of the retentive engagement portion 414 of the selector and the associated flat portion 416. Pushing or pulling on flanges 418 facilitates rotation of the profile. The resultant reduction or increase in contact surface and pressure between the two retentively interengaged profiles (depending on rotation direction) influences secure retention of the selector.

Figure 29:
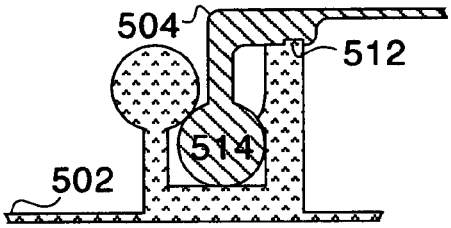
FIG. 29 is a cross-sectional view of the end of the retentively interengaged profiles of FIGS. 27 and 28 showing the selector secured at a selected position.
Figure 30:
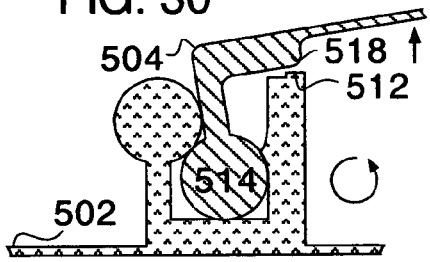
FIG. 30 is a cross-sectional view of the end of the retentively interengaged profiles of FIGS. 27 and 28 showing the selector rotated in the selectable member channel for movement to a new selectable position.
Figure 31:
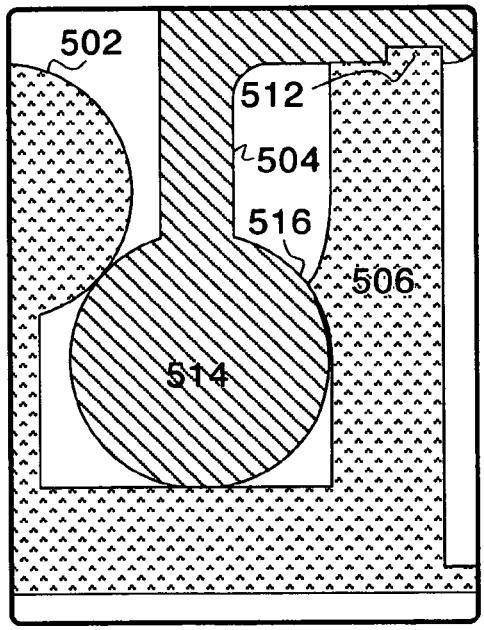
FIG. 31 is an enlarged fragmentary view of FIG. 29 showing the selector secured at a selected position.
Figure 32:
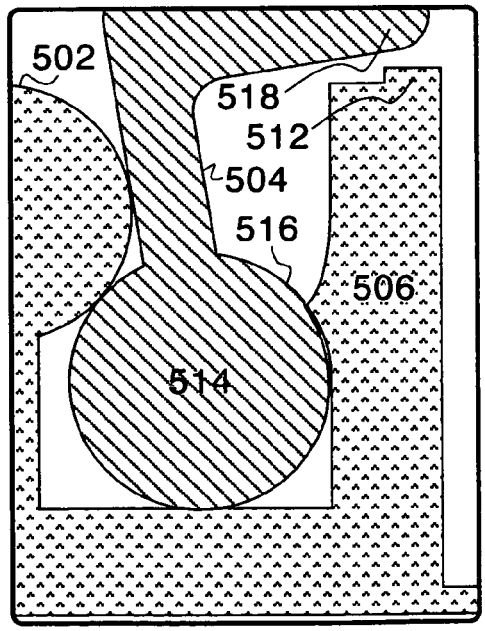
FIG. 32 is an enlarged fragmentary view of FIG. 30 showing the selector rotated in the selectable member channel for sliding movement to a new selectable position.

FIGS. 27-32 illustrate another plastic extruded profile 502 (for a selectable member) and a plastic selector 504 which are retentively interengageable with each other. As best seen in the perspective fragmentary view of FIG. 27, the preferably extruded profile 502 is flexible or resiliently deformable and includes resiliently deformable sidewalls or ribs 506 and a somewhat rectangular channel 508. One of the sidewalls includes a bulbous somewhat circular (in end cross-section) upper portion. The top 510 of the other sidewall includes a plurality of bumps, projections (or tabs) which act as anti-displacement stops or détentes 512 for hindering sideways or longitudinal movement (the direction shown by the multi-headed arrows) of the selector 504, when the selector is interlocked (retentively engaged) in the channel and in contact with the stops (FIGS. 29 and 31). The stops may be produced by any one of a number of suitable means known in the art, but are preferably produced by varying the die aperture during molten material flow through the extrusion die. In a reminder device of the present invention, the stops are located between selectable designated positions. The selector 504 may be cast or molded into the shape shown, but is preferably extruded as a profile and cut to suitable size to fit between the stops in the selectable member extrusion. The selector includes a bulbous somewhat circular (in end cross-section) engagement portion 514 including a slight protrusion or raised area 516 for in-channel securement, best seen in the enlarged fragmentary cross-sectional side views of FIGS. 31 and 32. The selector also includes a stop engagement portion (or tab) 518 for engaging the selectable member extrusion stop 512. FIGS. 29 and 31 show the selector secured at a selected position. The raised area 516 is in contact with the sidewall providing increased pressure and friction hindering displacement of the selector. The selector is also engaged with the top 510 of the sidewall at a portion between the protruding détentes 512 hindering even further sideways or longitudinal displacement of the retentively interengaged selector. To move the selector to a new position, a user lifts or rotates the selector to the position shown in FIGS. 30 and 32, slides the selector within the channel to the chosen position and rotates the selector back to the position shown in FIGS. 29 and 31. It should be noted that the selector can be engaged in the channel via the channel entry opening 511 as described in previous embodiments. The selector may also be engaged in the channel (slid into the channel) without deforming the channel walls via an open channel end if the selector is held in the tilted or rotated position shown in FIG. 32.

Figure 33:
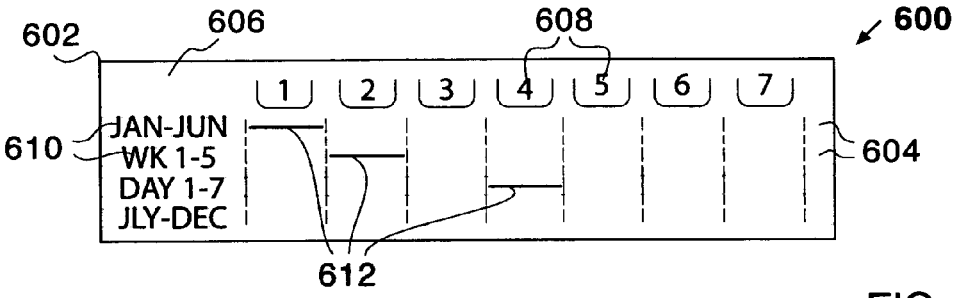
FIG. 33 is a planar view of the front of an additional embodiment 600 of the invention. In this example a plurality of interengaged members form a plurality of individually selected positions.
Figure 34:
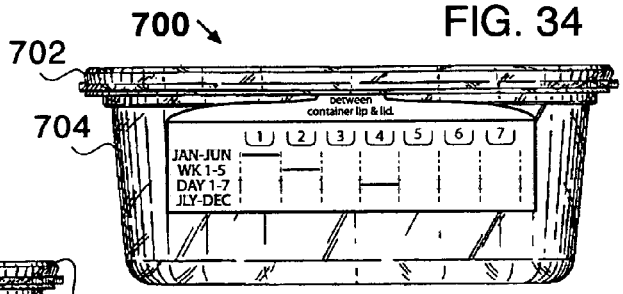
FIG. 34 is a planar view of the front of an additional embodiment 700 of the invention. In this example a reminder is attached to a reusable container by way of a tab in the device. The tab is trapped between the container upper rim and the container lid in the closed container.
Figure 35:
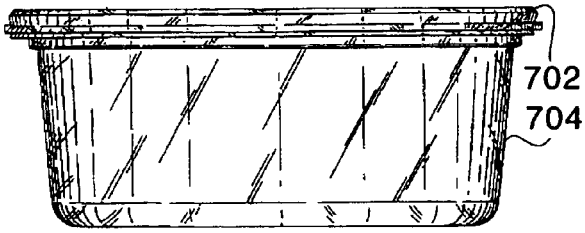
FIG. 35 is a planar view of the front of the closed container of FIG. 34 without the reminder attached.
Figure 38:
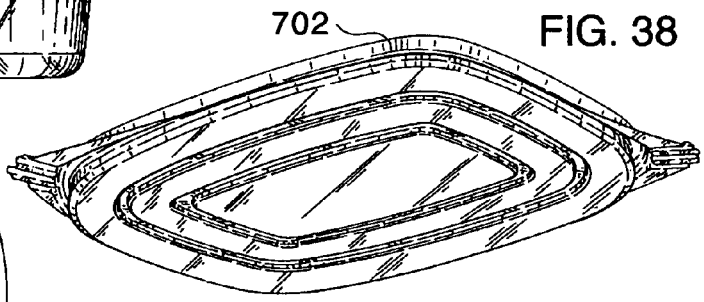
FIG. 38 is a perspective view of the lid of FIG. 34.

With reference now to FIG. 33, a third embodiment of the reminder device is generally illustrated at 600. A selectable member 602 in the present embodiment includes a plurality of retentively interengageable plastic profiles 604 arranged in rows and attached by suitable means to a deformable sheet member 606 including indicia 608 and 610 suitable for food storage. The indicia are arranged to designate rows and columns, and form an array of positions that are individually selectable by indicating portions on the selectable member. The device includes a plurality of selectors or indicators 612 that are interlockable or retentively interengageable with the plastic profiles at any one of the selectable positions. The selectors may be of any suitable construction and may or may not, as is necessary for the intended application, include a sheet member. As shown in the illustration, the selectors or indicators are moved preferably by sliding to the selectable positions to convey desired information. Such a device could find use when attached to containers or packages of foods in which knowledge of initial storage or initial consumption is desirable at a later time. Such a device could be particularly beneficial when attached to storage containers having some reuse capability.

Figure 37:
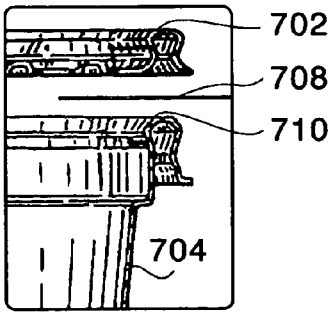
FIG. 37 is an enlarged fragmentary cross-sectional view of the end of FIG. 34 prior to closing the container with the lid.

With reference now to FIGS. 34 through 39, a fourth embodiment of the reminder device is generally illustrated at 700. The reminder device 700 is similar to reminder device 600 of the third embodiment of the invention. The non-adhesive back (not shown) of the sheet member in this embodiment is particularly adapted for attachment to and employment with reusable snap-close lid 702 containers 704 in widespread current use. It will be recognized by those skilled in the art that the non-adhesive back could carry adhesive that is blocked from acting in the present embodiment. The deformable sheet member 706 of device 700 further includes a tab extension 708 for attaching the reminder to the reusable container. As best seen in FIG. 37, to attach the reminder to the container, the tab extension of the reminder device is positioned between the top rim or lip 710 of the container and the lid of the container. The lid is pressed down onto the container so as to snap close the container with the lid, causing the easily deformable tab to conform to the curvature of the lip and thereby trapping the device tab and attaching the device to the container. Thus the reminder is held in place by the closed lid. Operation of the device is the same as in the third embodiment 600 of the invention. The reminder may be reset and reused with the same container or saved for use with another container when the container is discarded. It is anticipated that simple modifications could be made to the sheet to allow the device to work with other types of lids and containers including those which incorporate a different closing system.

FIG. 40 illustrates an end view of a channel member 802 and a cooperating complimentary rib member 804 wherein the profiles are similar to those of the first embodiment 100. FIGS. 41-51 depict a range of variations in construction of the cooperating members of FIG. 40, which can enhance functionality of the device.

FIG. 41 depicts a portion of a channel member 806 similar to that of channel member 802. The channel is shown expanded (the sidewalls resiliently deformed) from the normal retentively unengaged condition. The present channel member 806 further includes obstructions, détentes or stops 808 produced on the channel walls. Those skilled in the art are familiar with a number of techniques for producing such détentes by forming processes, but any suitable means will work. The size, shape, number and location of the détentes may of course vary from those depicted. The détentes 808 serve as ant-displacement means including anti-sliding means to secure a selection chosen by a cooperating complimentary member like that of rib member 804 retentively engaged in the channel. The détentes obstruct longitudinal sliding movement within, into and out of the channel by preferably engaging an end of the cooperating member. Engagement of another portion (e.g. a recessed portion) of the cooperating member to accomplish the same effect is of course possible. A thusly obstructed cooperating member in one portion of the channel can be located at a different portion in the channel by removal from the channel by way of the channel-longitude entry opening 809 and reinsertion at the new position by way of the channel-longitude entry opening 809. Alternately and preferably, movement to the new location is accomplished by forcefully sliding the still retentively engaged cooperating member past the obstructing détente. Movement may be accompanied by resilient or reversible expansion of the channel or resilient or reversible compression of the movable member, or both.

FIG. 42 depicts a portion of a rib member 810 similar to that of rib member 804 which can be engaged in a cooperating movable channel member similar to that of channel member 802. The rib member 810 further includes an obstruction, détente or stop 812 extending from an engagement surface. The size, shape, number and location of détentes may of course vary from those depicted. The détente 812 serves as ant-displacement means including anti-sliding means to secure a selection chosen by a cooperating movable member like that of channel member 802 engaged on the rib. The détentes obstruct longitudinal sliding movement within, into and out of the channel by preferably engaging a longitudinal end of the channel member and thereby obstructing movement. Engagement of another portion, (e.g. a recessed portion) of the channel member to accomplish the same effect is of course possible. An obstructed channel member can be located at a different portion of the cooperating member by removal from the rib member 810 by way of a channel entry opening and similarly reengaged at the new position. Alternately and preferably, movement to the new location is accomplished by forcefully sliding the still retentively engaged channel member past the obstructing détente 812. Another preferred method is slightly raising the channel member (to clear the détente) from the cooperating rib member and sliding the still retentively engaged channel member to the new position. Then reseating the channel member. Movement may be accompanied by resilient expansion of the channel or resilient compression of the movable member, or both.

FIG. 43 depicts a side cross-sectional view of a portion of a channel member 814 like that of channel member 802 in which a plurality of engageable ridges and grooves 816 are produced in a base at an interior surface of the channel. A cooperating complimentary rib member 818 like that of rib member 804 adapted for retentive engagement in the channel includes a plurality of engageable ridges and grooves 820 adapted to mate with the channel member ridges and grooves. Mating of the ridges and grooves serve as ant-displacement means including anti-sliding means to secure selected positions in the channel. The size, shape, number and location of mating ridges and grooves may of course vary from those depicted. Movement of the appropriate member to make a selection can be accomplished by at least one of the methods described for FIG. 41 or FIG. 42. Movement may be accompanied by resilient or reversible expansion of the channel or resilient or reversible compression of the complimentary rib, or both.

FIG. 44 is a fragmentary front view showing a channel 822 and a rib (shaded) 823 similar to those of embodiment 100. The channel, which is attached to a sheet (not shown), has been structurally segmented into a plurality of selectable longitudinal portions or structural segments 824, 826 and 828 by suitable means known in the art. Segmentation of the channel produces small spaces between adjacent portions or segments of the channel. The illustration shows these spaces occupied by the ends 834 and 836 of the rib 823. Adjacent channel segments may still continue to be joined by some portion of the channel structure such as for example the channel base or part of the channel wall, or be solely joined by the attached sheet (not shown). It should be noted that while the space between channel segments is shown to be of a particular relative size, such space can be varied considerably and still allow the device to operate correctly. The rib 823 retentively engaged in the channel structural segment 826 shows the channel structural segment 826 dimensionally varied or resiliently expanded (from the retentively unengaged channel). The respective ends 830 and 832 of channel structural segments 824 and 828 will make contact with the end (834 or 836) of the movable rib member providing anti-displacement means including anti-sliding means holding the movable member at the selected position. Structurally segmenting or sectioning of a channel (between selectable positions) either with or without pronounced spaces between channel segments facilitates attachment of the channel member to a container or other article when selectable positions are to lie along a curved path like that shown in FIG. 12 of embodiment 100. In some such cases a portion of the channel member proximate to the end can similarly act as anti-displacement means including anti-sliding means. Structurally segmenting a rib for a similar application could of course provide similar benefits. Sectioned or structurally segmented profiles also permit a somewhat more rigid member to be mounted on a non-flat surface or along a non-linear path of a container (e.g. curved exterior wall of a vial or a flexible pouch or bag). Use of somewhat more rigid material can improve operation of the device in some applications. It is to be considered that such sectioning can be accompanied if desired, by heat or mechanical means well known in the art to concurrently or somewhat concurrently produce détentes or obstructions, either at the location of sectioning or at another desired location in the member.

Turning to FIG. 45, it can be seen that the ends 834 and 836 of the movable rib member 823 have been tapered or angled (by any suitable method, die cutting etc.) to facilitate open-end entry into a channel segment. The leading rib portions 838 or 840 can be made to slideably enter the respective channel ends 830 or 832 of channel structural segments 824 and 828 while still partially engaged in channel structural segment 826. Guided by leading portion entry into the destined channel segment, the movable rib member may forcefully be slid into the new channel structural segment (824 or 828) by single digit contact with the rib 823, in the process expanding the new channel segment and retentively engaging the rib in the new channel segment. The exited channel structural segment 826 returns substantially or entirely to the unexpanded channel segment condition.

FIG. 46 shows cooperating complimentary channel member 842 and rib member 844 similar to those of FIG. 40, but illustrates a different relative orientation. The location of engagement areas and the relative orientation of retentively engageable cooperating members can vary considerably from those depicted and still produce a correctly operating device.

Figure 47:
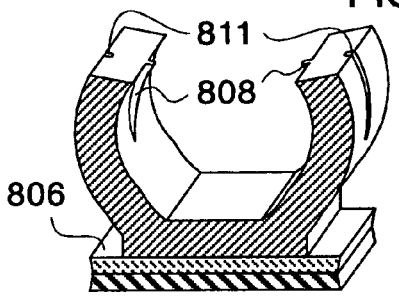
FIG. 47 is a perspective view of a variation of the portion of the channel profile of FIG. 41.

FIG. 47 is a perspective view of a variation of the portion of the channel profile of FIG. 41. The channel wall has both a protrusion détente 808 and a recess détente 811 intended to engage a complimentary member either in the channel or on the outside of the channel walls or ribs in order to restrict longitudinal movement. The design provides for anti-displacement means including anti-sliding means while allowing the profile to act as a female or male to the complimentary member.

Figure 48:
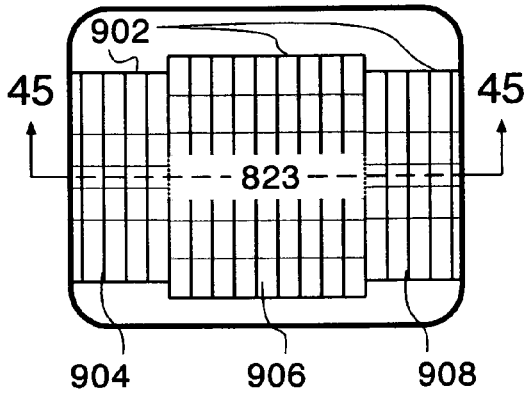
FIG. 48 is a fragmentary front view showing the rib of FIG. 44 retentively engaged at a selected reminding position in a finely segmented channel.

FIG. 48 is a fragmentary front view showing the rib 823 of FIG. 44 retentively engaged at a selected reminding position 906 in a finely structurally segmented channel 902. The rib occupies a plurality of channel segments at the selected position. The channel segments adjacent to the end of the rib, at the adjacent selectable reminding positions 904 and 908, as previously explained provide anti-displacement means including ant-sliding means. A user can forcefully overcome the anti-displacement engagements and slide the rib member to a newly selected position. In the present illustration, the channel has been structurally segmented by die cutting the channel while leaving the sheet (not shown) to which the channel is attached unaltered. The finely segmented channel 902 can be used with a wide variety of containers and articles as shown in FIGS. 49-51.

Figure 49:
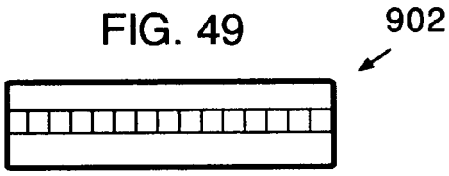
FIG. 49 is a top view of the channel of FIG. 48 as it appears attached to a flat wall of a container. The container is not shown for simplicity.

FIG. 49 is a top view of the channel of FIG. 48 as it appears attached to a flat wall of a container. The container is not shown for simplicity.

Figure 50:
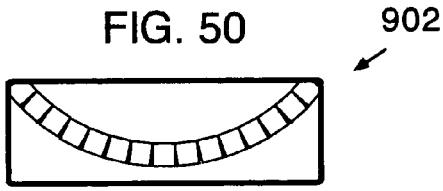
FIG. 50 is a top view of the channel of FIG. 48 as it appears attached to a moderately curved wall of a container. The container is not shown for simplicity.

FIG. 50 is a top view of the channel of FIG. 48 as it appears longitudinally conformably attached to a moderately curved wall of a container. The container is not shown for simplicity.

Figure 51:
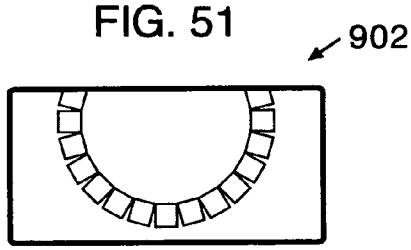
FIG. 51 is a top view of the channel of FIG. 48 as it appears attached to a highly curved wall of a container. The container is not shown for simplicity.

FIG. 51 is a top view of the channel of FIG. 48 as it appears longitudinally conformably attached to a highly curved wall of a container. The container is not shown for simplicity.

It is evident from the illustrations (FIGS. 49-51) that it is possible to advantageously produce a single device according to the present invention in which the longitude can adequately conform to great ranges in the radius of curvature. And it is also possible to advantageously produce a single device according to the present invention in which the width (not shown) can adequately conform to great ranges in the radius of curvature. Preferably construction permits the longitude of the single device to conform to a radius of curvature between one approaching infinity and one less than 14 mm. It should be noted that such deformability is not strictly necessary to produce the device and a device having the ability to conform to a radius of curvature of say less than 40 mm, or a larger radius of curvature could be adequate for many applications. It is to be considered that the channel member can be constructed of sufficiently deformable and sufficiently rigid material such that selectable positions and therefore the channel segments need not all necessary lie in the same horizontal or vertical or curved plane and that a channel member may be twisted for some applications. It is also to be considered that while the exemplary illustrations show a finely segmented channel and a rib member sliding within the channel segments, it is possible to construct a comparable device having a finely segmented rib and a channel member sliding on the rib segments.

FIG. 52-59 depict an additional preferred fifth embodiment 1000 of the invention, which employs another retentively interengaging rib and channel combination to produce the device.

Figure 52:
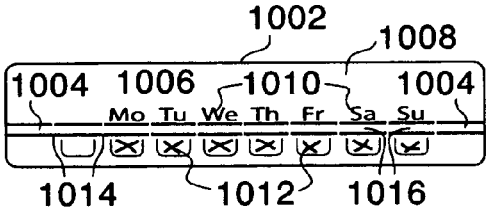
FIG. 52 is a view of the front of the selectable member of embodiment 1000 of the invention.

FIG. 52 shows a support member or a deformable selectable channel member 1002, which is transparent or translucent, and includes a longitudinal channel 1004. The deformable channel 1004 is suitably produced and suitably attached to the front surface (preferably a viewing surface) 1006 of a deformable sheet 1008 by any suitable means known in the art. The sheet carries a suitably produced array of schedule indicia 1010 which may be customized 1012 at a suitable time by suitable automated or manual means known in the art. The channel 1004 has been structurally segmented 1014 by suitable means to produce a plurality of selectable reminding positions corresponding to structural segments 1016 of the channel 1004, an individual reminding position exclusively referencing an individual value in the array. The channel 1004, which is later described in greater detail, defines an area for retentively engaging a complimentary deformable selector rib member 1020, which is also transparent or translucent.

Figure 53:
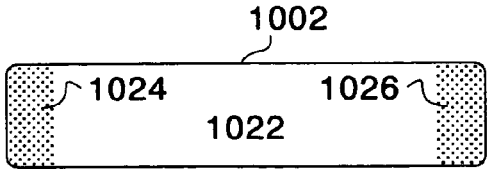
FIG. 53 is a view of the back of the selectable member of FIG. 52.

FIG. 53 depicts the back surface 1022 of the selectable member 1002. The back surface is shown carrying a pattern of adhesive 1024 and 1026 which is preferably pressure sensitive. The adhesive may be applied or distributed in a pattern by way of any suitable method known in the art. Patterns of adhesive other the one displayed may be suitable for many applications. Aside from providing a means for finally attaching the device to an article for use, the adhesive can serve to facilitate processing by carrying the sheet 1008 as a removable top sheet on a removable release liner (not shown)

Figure 54:
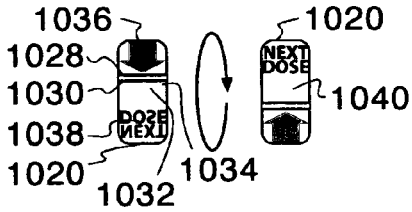
FIG. 54 is a view of the first surface and a view of the viewing surface of the selector member of embodiment 1000 of the invention.

FIG. 54 depicts the selector rib member 1020, which includes a plurality of deformable ribs 1028 and 1030 defining an area adapted to receive retentive engagement in said channel 1004. The ribs 1028 and 1030, which are later described in greater detail, are suitably produced and suitably attached to a first surface 1032 of a deformable sheet 1034, by any suitable means known in the art, said first surface 1032 opposing a viewing surface 1040 of the sheet 1034. Processing of the selector member may be facilitated by releaseably carrying the sheet 1034 on an adhesive liner (not shown). The sheet carries selecting indicia 1036 and 1038, suitably produced such that when the ribs of the selector are retentively engaged in the channel, the selecting indicia are correctly positioned and correctly oriented for viewing at the viewing surface. It should be noted that the selector sheet, the indicia carried by the selector sheet, and the adhesive selector liner are all not strictly necessary to produce the device. A selector member constructed without these elements will work well in many applications.

Figure 55:
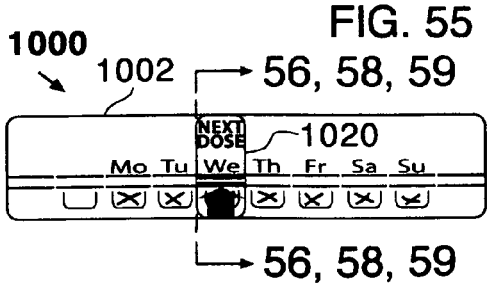
FIG. 55 is a front view of the selectable member of FIG. 52 retentively engaged with the selector member of FIG. 54.

FIG. 55 depicts the selector 1020 of FIG. 54 retentively engaged or interlocked with the selectable member of FIG. 52. To retentively interengage the two members, the selector is positioned over the channel at one of the selectable positions, turned over (FIG. 54) such that the selector ribs faces the selectable support member channel (selector viewing surface toward user), and the two members pressed together to snappingly engage the two to produce the engaged assembly shown.

FIGS. 56-59 show engagement of the selector 1020 with the selected channel segment 1016 of the selectable member 1002 of the embodiment 1000 in greater detail. Such engagement may be performed manually or such engagement may be automated as later described.

FIG. 56 is a cross-sectional view showing the end of the structural segment 1016 of the selectable member 1002 of the invention. Only a portion of the selectable member sheet is shown. The channel is shown defined by a pair of ribs 1050 and 1052, forming the channel walls, and a channel base 1054 joining the ribs. The sheet 1008, shown in cross section, is attached to the channel base. It is to be considered that the channel base is not strictly necessary to produce the channel and that a working equivalent channel may be produced by attaching the pair of ribs directly to the sheet. A channel-longitude entry opening 1056 provides a pathway for initial entry of the selector (shown positioned for entry) into the channel for retentive engagement assembly of the two members. Protrusions 1058 and 1060, produced in the channel ribs, narrow channel segment end entry openings 1072 only at said (1072) entry openings and obstruct or restrict entry into the channel. Once the ribs (1028 and 1030) are retentively engaged in the channel 1004, the channel entry opening 1072 serves as a channel exit opening, restricting the exit of the ribs from the channel. The selectable member 1002 could serve either as a channel member or as a rib member for some other embodiments. Also seen in FIG. 56 is a view of the end of the selector member 1020 of the invention. Only a portion of the selector member sheet is shown. The selector member includes the pair of resiliently deformable ribs 1028 and 1030 joined by a base 1062 and together they define a second channel 1064 between the ribs and which channel is accessible by way of channel-longitude entry opening 1066. The sheet 1034 is attached to the selector channel base. It is to be considered that the selector base is not strictly necessary to produce the second channel and that working equivalent ribs may be produced by attaching the pair of ribs directly to the sheet. The selector member 1020 could serve either as a channel member or as a rib member for some other embodiments. In this example the selectable member ribs are less deformable than the selector member ribs due to greater wall thickness, but complimentary members having ribs of the same wall thickness or of equal deformability would also work in some applications. As can be seen in the illustration, the channel-longitude entry opening 1056 of the selectable member is narrower or smaller in width 1068 than the selectable member channel 1004 (channel width 1070). The channel entry opening 1056 is also narrower 1068 than the selector rib engagement width 1070.

FIG. 57 is a perspective view of the members shown in FIG. 56.

FIG. 58 shows the selector member being inserted into the selectable member by way of the channel entry opening 1056 along the longitude of the selectable member channel segment. The ribs 1028 and 1030 are shown deforming toward each other to fit through the opening.

As best seen in FIG. 59, which shows the fully inserted selector, the selector ribs resiliently return to substantially or entirely their original position to retentively engage the selectable member. The selectable member protrusions 1058 and 1060 at the end openings 1072 trap the selector member ribs in the channel and obstruct or restrict longitudinal displacement of the selector out of the channel segment. By applying suitable force to the selector in the direction of an adjacent structural segment, a user following a dosage regimen can overcome the restrictions and select a next dose position by sliding the selector from one structural segment to the next. The selector can bypass or slide past the channel entry opening 1072 obstructions (1058 and 1060) restricting entry and exit because such forceful sliding of the selector will deform the selector ribs towards each other and permit selector entry into the adjacent selectable member channel segment via the segment end. It is obvious that the ribs and base employed in the selectable member 1002 could be replaced by the ribs and base employed by the selector member 1020 and vise versa to produce a similarly operating equivalent device in which the selectable member is retentively engaged in the selector member.

FIG. 60 depicts an additional sixth embodiment of the invention wherein multiple selectable members 1102 and multiple selector members 1106 are collectively denoted as embodiment 1100. The multiple selectable members 1102 are arranged on a continuous strip or web 1104. The continuous strip 1104 may be formed into a roll or folded in an accordion-style stack. The selectable members 1102 may be fed sequentially into a specialized printer configured to print desired indicia onto the selectable member sheets. Placing the selectable members on a continuous strip may facilitate automated printing and automated or manual application of the selectable members onto pharmaceutical containers. Printing is preferable prior to selectable member assembly with the selector member, but could work after assembly in some applications. Although not shown, the continuous strip includes the sheet containing the selectable members and a release liner removably attached to the sheet. As is known in the art, die cuts or perforations may be employed between individual selectable members to facilitate dispensing and application. Abutting the members is preferable to conserve material, but spacing between members may work better on some equipment. Automated application may be accomplished by adapting label application equipment in common use.

FIG. 60 also shows the multiple selector members 1106 arranged on a continuous strip or web 1108. The continuous strip 1108 may be formed into a roll or folded in an accordion-style stack. Placing the selector members on a continuous strip may facilitate automated or manual dispensing and automated or manual assembly with the selectable member. Although not shown, the continuous strip includes the sheet containing the selector members and an adhesive liner removably attached to the sheet. As is known in the art, die cuts or perforations may be employed between abutting individual selector members. Abutting the members is preferable to conserve material, but spacing-apart the members may work better on some equipment. It is to be considered that the adhesive liner may be omitted for some applications. The selector member may be assembled with the selectable member before or after applying the selectable member to a container.

Figure 61:
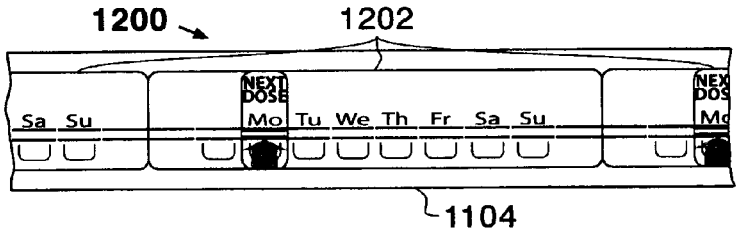
FIG. 61 is a front view of embodiment 1200 of the invention wherein a multitude of devices assembled from the members of FIG. 60 are arranged on a strip.

FIG. 61 depicts an additional seventh embodiment of the invention wherein the multiple selectors of FIG. 60 are automatically assembled with the multiple selectable members of FIG. 60 to produce a strip of multiple reminder devices (collectively 1200) for subsequent automated or manual dispensing or issuing or subsequent automated or manual application to an article. Numerous suitable automated assembly methods applicable to assembly of the members are known in the art. Typically such methods may include motors, rollers, cutters, dispensing and take-up reels, folders, vacuums, applicators, timers, cylinders, feeders, grippers, tensioners, electronic readers or scanners, etc. The sequence of steps for assembly may be greatly varied and still produce an assembled equivalent reminder device. An exemplary method advances the selectable members of FIG. 60 from a rolled web of selectable members at a first controlled rate along a direction to a take-up reel. A second rolled web of the selector members of FIG. 60 is advanced or conveyed at a second controlled rate in the same direction such that a selector member is at some point of the advancement superimposed (ribs of selector facing channel of selectable member) on the selectable member at the channel-longitude entry opening. The selector adhesive liner, if present, is preferably released prior to cutting a selector from the multiple selector strip for subsequent assembly. A pressure or pinch roller in the travel path forces the selector ribs into the channel. The first and second controlled advancement rates are coordinated to combine a single selector with a single selectable member. The assembled devices 1202 are wound into a roll on the take-up reel for further handling.

FIGS. 62-66 depict an additional eighth embodiment 1300 of the invention wherein retentive engagement of a resiliently deformable selector with a resiliently deformable selectable member is possible at one of a multitude of substantially parallel positioned portions located at one of a plurality of selectable positions. The construction allows for fault-tolerant or wide-tolerance assembly. The selector and selectable member may be produced on a common sheet.

Figure 62:
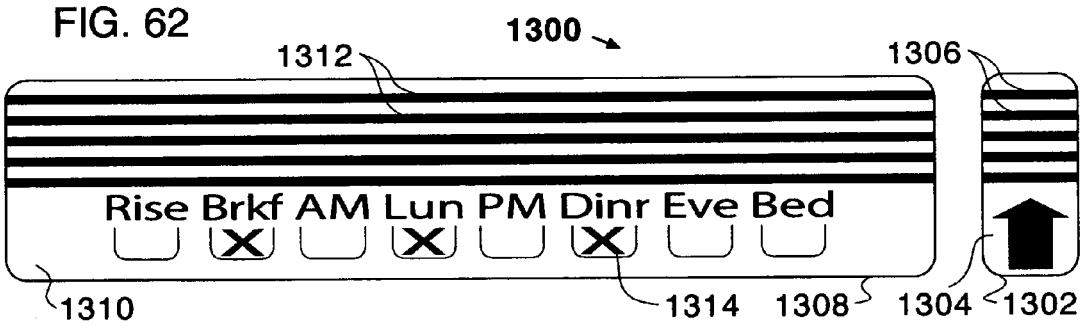
FIG. 62 is a front view of embodiment 1300 of the invention wherein one of a plurality of substantially parallel areas at a selectable position may be operationally engaged. A selectable member and unassembled selector member of the device are shown.
Figure 63:
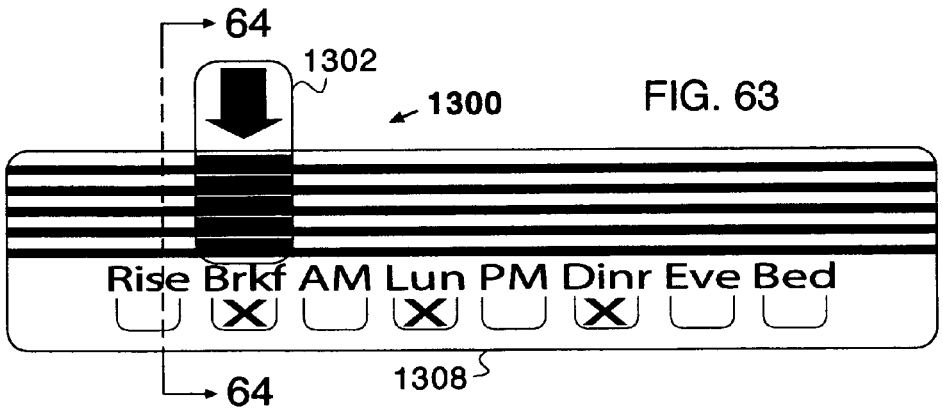
FIG. 63 is a front view of the assembled members of FIG. 62.

FIG. 62 depicts a selector member 1302 including a sheet 1304 including a plurality of engageable rib profiles 1306 directly attached to said sheet 1304 and arranged in somewhat parallel fashion across the sheet 1304 such that channels are produced between adjacent ribs.

FIG. 62 also depicts a selectable member 1308 (cooperating with the selector member 1302) including a sheet 1310 including a plurality of duplicate rib profiles 1312 directly attached to said sheet 1310 and arranged in somewhat parallel fashion across the sheet 1310 such that channels are produced between adjacent ribs, the ribs of one of said members being retentively engageable in the channels of the cooperating member. The selectable member further includes a plurality of selectable reminding positions designated by indicia 1314 customizing a schedule.

As best seen in FIGS. 63 through 66, the selector is retentively engageable at one of a plurality of substantially parallel portions of the selectable member located at a selected position. Retentive engagement of any one of the pluralities of parallel portions by the cooperating member is sufficient to produce a correctly operating device. Retentive engagement of the cooperating members is accomplished by pressing the two members together as described in previous embodiments at channel entry openings 1316, having an individual width 1318. Resiliently collapsible bulbous portions of the ribs, having a normally uncollapsed individual width 1320 greater than width 1318, resiliently deform under assembly force (suitably narrowing and then expanding) to retentively interengage in the cooperating channels, having an individual width 1322 greater than width 1318. While the channel entry opening 1316 restricts access of the retentive engagement portions of the rib to the retentive engagement portions of the channel, the restrictions are overcome by the resilient compression or resilient deformation of the ribs when the two members are pressed together similarly to previous embodiments. The engagement portions of the ribs thereby bypass or move past the restrictions. The selector is slideable to each of the plurality of selectable reminder positions in the engaged conditions depicted in the figures. As can be seen by comparing FIGS. 63 and 64 to FIGS. 65 and 66, the redundancy provided by the extra engageable parallel portions serves to facilitate engagement as the potential engagement area is broadened. Such construction provides greater tolerance for assembly and eases suitable alignment requirement for users and automated machinery.

Figure 67:
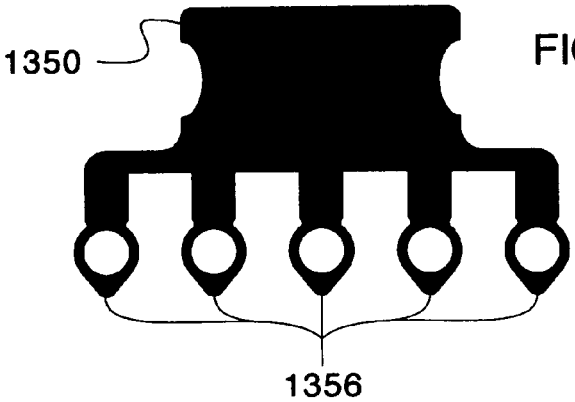
FIG. 67 is an end cross sectional view of a selector member produced without a sheet. The present selector may be substituted for the selector of FIG. 62 in the device of FIG. 62.

FIG. 67 depicts a selector profile member 1350 including a multitude of ribs 1356 like the ribs 1306 of the previous embodiment 1300. The present ribs however are not directly attached to a sheet. The entire selector profile 1350 in the present instance is preferably produced by extrusion. The selector member 1350 may be substituted for selector member 1302 of embodiment 1300 to produce a reminder device according to the invention. It is therefore obviously possible to construct a device with only one of the retentively engaged members including a sheet.

Figure 68:
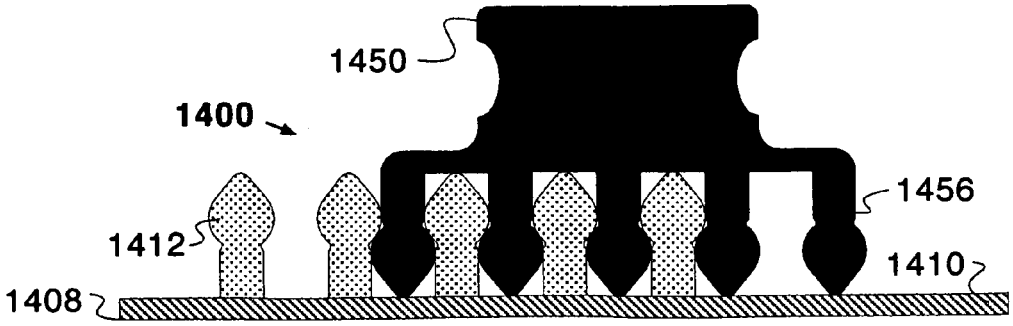
FIG. 68 is an end cross sectional view of a selectable member similar to that of FIG. 66 and an end view of a selector member similar to that of FIG. 67 wherein the members are constructed from a reversibly compressible material.

FIG. 68 depicts an additional ninth embodiment 1400 of the invention wherein a resiliently compressible material allows for retentive and/or anti-displacement engagement of cooperating members in the device. The selector member 1450 is produced from suitable sponge-like structured material or open celled material. Bulbous ribs 1456 which form the channel walls of the selector are thereby resiliently compressible. Compression of selector ribs concomitantly narrows the bulbous portions and expands the selector channel entry openings between the ribs. The selectable member 1408 ribs 1412 and sheet 1410 are constructed of suitable compressible material like that of the selector. Constructing the sheet of a material different from that of the ribs may work well in some applications. Retentive interengaging assembly of the device members 1450 and 1408 and operation of the reminder device 1400 are the same as for embodiment 1300. Pressing together the two members (initial assembly) at the longitudinal channel entry openings causes the ribs to compress temporarily and then expand to retentively interengage. Preferably some degree of pressure is maintained between adjacent ribs, but such pressure is not strictly necessary to produce the device. The material may be engineered, and rib spacing adjusted, as is known in the art to provide desirable assembly and operational characteristics. Sliding the selector to a newly selected position preferable requires some degree of force to again temporarily compress the ribs, or expand to the channels, or to overcome resistance or to overcome obstructions or restrictions to movement. For example, the bulbous portions of the ribs may be held in the channels by a controlled amount of resilient compression (stressed state under retentive interengagement). Inherent memory in the deformed material attempting to return the ribs to their unstressed state presses the interengaged adjacently ribs together, the condition serving as anti-displacement means including ant-sliding means.

It is to be noted that in the above embodiments a rib member can interlock with or retentively interengage with a channel member by crossing the channel entry opening to enter the channel. Said crossing is accompanied by said device members engaging deformably at the channel entry opening. Said crossing deformation may be limited to the either the rib member or to the channel member of a given device, or said crossing deformation may occur in both members of said device.

It is evident from the descriptions above that the disclosed reminder device has a number of advantages. Still other advantages will become apparent upon further consideration. The device can be attached to either flat or curved surfaces and the attachment surface can be rigid or flexible. The device can therefore be used with a great number of containers including, but not being limited to vials, bottles, bags, pouches, blister cards, cartons, and pharmacy containers.

The device is easy to apply and assemble, application being similar to a pressure sensitive label and assembly being similar to snap closures on plastic bags in widespread use. Construction for fault-tolerant or wide-tolerance assembly is also possible. Assembly and application may be automated using known techniques. A user can slide the selector from a first selected position to a next-dose period by contacting the selector with only a single digit. Materials employed are relatively inexpensive and production employs well-established schemes in current use. Device materials are relatively robust and normal operation of the device has little effect on expected product life. Thus the reader will see that the invention provides significant and material improvements over prior designs for low-cost extended use. It is also anticipated that the disclosed construction of the device (ex. snappingly retentive engagement, sliding movement, anti-sliding means, etc.) could find application in many other kinds of devices.

While the above descriptions contain many speceficities, these should not be construed as limitations on the scope of the invention, but rather as exemplifications of the embodiments thereof. Various alterations or changes can be made without departing from the spirit and broader aspects of the invention as defined in the appended claims. Many other variations are possible. The exact profile configuration for some applications may be one of many conventional shapes that are well known in the art. That many other profiles, other profile combinations and other combinations of selectable members and selectors can effectively be used in the device, will become apparent to those skilled in the art. It is anticipated that retentively interengaging members will be engineered that require different levels of force to retentively interengage, move from selected positions, separate, retentively reengage or that cannot be separated without destroying the device. It is anticipated that anti-displacement means could easily be provided by inherent material characteristics (ex. tackiness, bumps, irregular surface, etc.) or be provided by the characteristics imparted by coatings or treatments applied to members (ex. surface treatment, tack coating, friction coating, texturizing of surface, etc.). Ant-displacement apertures, tabs, notches and teeth of all sorts could also be employed.

It is anticipated that obstructions and detents of equivalent effect could be produced in device members by any one or all of the techniques known in the art. For example, varying extrusion speed, varying die apertures under running conditions, selective application of heat, selective application of pressure, etc. It is anticipated that a selectable member and cooperating selector member could carry no indicia and still serve as an operational device by equivalent means so long as the selector is movable to a discernable reminding position. Many of the embodiments show channels having open longitudinal ends and a channel entry opening along the channel longitude between the longitudinal ends. These are preferably produced by extrusion means. It is however anticipated that for some applications and for some manufacturing facilities channels that have closed longitudinal ends would work well. It is also anticipated that suitable channels could be produced by other suitable means such as injection molding etc. It is anticipated that many of the methods used for channel structure variation could be suitable and could be applied to ribs and vice versa. It is contemplated that the adhesive in members could include any attaching and joining means including various chemical adhesives, magnets, tapes, and mechanical couplers and fasteners. It is also contemplated that the device could be manufactured or provided attached or adapted for attachment to a suitable article such as for example a flexible plastic bag, a rigid vial, a card, a carton etc. It is still further contemplated that the device could be provided either attached or unattached to an article wherein both cooperating profiles are not attached to a sheet. It is also contemplated that a sheet in the device could have raised or lowered patterns, a variety of surface finishes, corrugations etc., all while remaining within the scope of equivalence for the purposes of the device. It is finally contemplated that any openings describable as channel entry openings could be used as or incorporated in channel exit openings for some applications.

Any reference to claim elements in the singular, for example using the articles "a", "and" or "said" is not to be construed as limiting the element to only one element unless so specifically stated. The claims are to be interpreted in accordance with the principles and patent law including the doctrine of equivalence.

What I claim as my invention is:

1. A reminder device comprising:

a. a selector profile member including a front and a back and a surface from which a selector profile of the selector profile member projects, said selector profile defining a structural area of said selector profile for retentive engagement;

b. a selectable profile member cooperating with said selector profile member, said selectable profile member including a front and a back and a plurality of selectable profile segments projecting from a surface of said selectable profile member, each of said selectable profile segments defining a structural area of said each selectable profile segment for retentive engagement therewith said retentive engagement area of said selector profile, and each of said selectable profile segments capable of corresponding to a reminding position at which said selector profile member can cooperate with cooperating indicia;

c. said selector profile and said each selectable profile segment sufficiently complimentary in shape to allow the retentive engagement area of the selector profile to retentively engage with the retentive engagement area of the selectable profile segment;

d. at least one of said selector profile and said one of said selected profile segments resiliently deforming to allow said area of said selector profile to engage said area of said selected profile segment;

e. said selector profile of said selector profile member slideably engageable with one of said profile segments of said selectable profile member to each of said retentive engagement areas of said selectable profile member, such that the selector profile retentive engagement area located at a first said retentive engagement area of a first one of said profile segments selected by said selector profile is relocated from said first retentive engagement area to a second said retentive engagement area of a second one of said profile segments selected by said selector profile;

f. a first one of said cooperating selector profile member and said cooperating selectable profile member including at least one cooperating rib profile and the second one of said cooperating profile members including at least one channel profile cooperating with said cooperating rib profile;

g. said selectable member capable of attaching to substantially planar flat surfaces and to curved surfaces and said selectable member capable of conforming to the substantially planar flat geometry of the substantially planar flat surfaces and capable of conforming to the curved geometry of the curved surfaces, and said selectable member capable of conforming to said geometries while maintaining the slideability of the selector member to each of said retentive engagement areas of said selectable member.

2. The device of claim 1 and further including anti-displacement means for keeping said selector member at one of said selectable segments.

3. The device of claim 1 wherein said anti-displacement means is one chosen from a list which includes; a détente, a groove, an obstruction, friction, a deformation of one of said device profiles, a second unselected selectable member profile segment selectable by the selector profile member keeping the selector profile member at a first selected segment of said selectable profile member.

4. The device of claim 1 wherein said selector member profile retentively engaged with a selected one of said plurality of profile segments, remains at said selected profile segment by way of said selector member profile keeping said selected profile segment resiliently deformed.

5. The device of claim 1 and further including attachment means for attaching said device to an article.

6. The device of claim 5 wherein said attachment means is one chosen from a list which includes; an adhesive, a container lid, a container rim, a tab.

7. The device of claim 5 wherein said article is one chosen from a list which includes; a bag, a container, a deformable sheet, a pharmacy container, a flexible pouch, a sheet, a vial, a label.

8. The device of claim 1 wherein said device is attached automatically, said automated attachment being one chosen from a list which includes; automated attachment of said selector member to said selectable member, automated attachment of one of said cooperating members to an article, automated attachment of one of said cooperating members to a support surface, automated attachment of one of said cooperating members to a container, automated attachment of one of said cooperating members to a label.

9. The device of claim 1 wherein said selector member profile is digitally relocated by digitally contacting said selector member with less than two digits the entire time said selector member profile is relocated from said first selected retentive engagement area to said second selected retentive engagement area.

10. The device of claim 1 wherein said selectable profile member further includes a deformable sheet from a surface of which said selectable member profile segments project.

11. The device of claim 1 wherein the surface to which said selectable member is capable of attaching and conforming has a radius of curvature greater than 14 mm and less than infinity.

12. The device of claim 1 wherein said first selectable profile segment of said selectable profile member is contiguous with said second selectable profile segment of said selectable profile member.

13. The device of claim 1 wherein said first selectable profile segment of said selectable profile member is distinguished from said second selectable profile segment of said selectable profile member by way of a demarcation between said first and said second profile segments, said demarcation being one chosen from a list which includes; a cut between said first and said second profile segments, an opening between said first and said second profile segments.

14. The device of claim 1 wherein said cooperating members are differentiated by a color difference between said selector profile member and said selectable profile member.

15. The device of claim 1 wherein said first one of said cooperating selector profile member and said cooperating selectable profile member including said at least one cooperating rib profile comprises a plurality of rib profiles; and wherein said second one of said cooperating profile members including said at least one channel profile includes at least one chosen from a list which comprises a plurality of channel profiles and a profile having first and second channel sidewalls wherein the first sidewall forms a rib profile along its length.

16. The device of claim 1 wherein one of said profiles is collapsible.

17. The device of claim 1 wherein the entire sliding engagement of said selector profile occurs predominantly at the front of said device when said selector profile relocates from one of said selected profile segments to a second of said selected profile segments.

18. A reminder device comprising:

a. a selector profile member including a front and a back and a surface from which a selector profile of the selector profile member projects, said selector profile defining a structural area of said selector profile for retentive engagement;

b. a selectable profile member cooperating with said selector profile member, said selectable profile member including a front and a back and a plurality of selectable profile segments projecting from a surface of said selectable profile member, each of said selectable profile segments defining a structural area of said each selectable profile segment for retentive engagement therewith said retentive engagement area of said selector profile, and each of said selectable profile segments capable of corresponding to a reminding position at which said selector profile member can cooperate with cooperating indicia;

c. said selector profile and said each selectable profile segment sufficiently complimentary in shape to allow the retentive engagement area of the selector profile to retentively engage with the retentive engagement area of the selectable profile segment;

d. at least one of said selector profile and said one of said selected profile segments resiliently deforming to allow said area of said selector profile to engage said area of said selected profile segment;

e. said selector profile of said selector profile member slideably engageable with one of said profile segments of said selectable profile member to each of said retentive engagement areas of said selectable profile member, such that the selector profile retentive engagement area located at a first said retentive engagement area of a first one of said profile segments selected by said selector profile is relocated from said first retentive engagement area to a second said retentive engagement area of a second one of said profile segments selected by said selector profile;

f. a first one of said cooperating selector profile member and said cooperating selectable profile member including at least one cooperating rib profile and the second one of said cooperating profile members including at least one channel profile cooperating with said cooperating rib profile;

g. and said selector member profile retentively engaged with a selected first of said plurality of profile segments, remaining at said first selected profile segment by way of said selector member profile keeping said first selected profile segment resiliently deformed.

19. The device of claim 18 wherein said selector profile member is further kept at said first selected profile segment by way of a second unselected selectable member profile segment selectable by said selector profile member.

20. The device of claim 18 and further including attachment means for attaching said device to an article.

21. The device of claim 20 wherein said attachment means is one chosen from a list which includes; an adhesive, a container lid, a container rim, a tab.

22. The device of claim 20 wherein said article is one chosen from a list which includes; a bag, a container, a deformable sheet, a pharmacy container, a flexible pouch, a sheet; a vial, a label.

23. The device of claim 18 wherein said device is attached automatically, said automated attachment being one chosen from a list which includes; automated attachment of said selector member to said selectable member, automated attachment of one of said cooperating members to an article, automated attachment of one of said cooperating members to a support surface, automated attachment of one of said cooperating members to a container, automated attachment of one of said cooperating members to a label.

24. The device of claim 18 wherein said selector member profile is digitally relocated by digitally contacting said selector member with less than two digits the entire time said selector member profile is relocated from said first selected retentive engagement area to said second selected retentive engagement area.

25. The device of claim 18 wherein said selectable profile member further includes a deformable sheet from a surface of which said selectable member profile segments project.

26. The device of claim 18 wherein said first selectable profile segment of said selectable profile member is contiguous with said second selectable profile segment of said selectable profile member.

27. The device of claim 18 wherein said first selectable profile segment of said selectable profile member is distinguished from said second selectable profile segment of said selectable profile member by way of a demarcation between said first and said second profile segments, said demarcation being one chosen from a list which includes; a cut between said first and said second profile segments, an opening between said first and said second profile segments.

28. The device of claim 18 wherein said cooperating members are differentiated by a color difference between said selector profile member and said selectable profile member.

29. The device of claim 18 wherein said first one of said cooperating selector profile member and said cooperating selectable profile member including said at least one cooperating rib profile comprises a plurality of rib profiles; and wherein said second one of said cooperating profile members including said at least one channel profile includes at least one chosen from a list which comprises a plurality of channel profiles and a profile having first and second channel sidewalls wherein the first sidewall forms a rib profile along its length.

30. The device of claim 18 wherein one of said profiles is collapsible.

31. The device of claim 18 wherein the entire sliding engagement of said selector profile occurs predominantly at the front of said device when said selector profile relocates from one of said selected profile segments to a second of said selected profile segments.

32. A method comprising:

a. providing a selector profile member including a front and a back and a surface from which a selector profile of the selector profile member projects, said selector profile defining a structural area of said selector profile for retentive engagement;

b. providing a selectable profile member cooperating with said selector profile member, said selectable profile member including a front and a back and a plurality of selectable profile segments projecting from a surface of said selectable profile member, each of said selectable profile segments defining a structural area of said each selectable profile segment for retentive engagement therewith said retentive engagement area of said selector profile, and each of said selectable profile segments capable of corresponding to a reminding position at which said selector profile member can cooperate with cooperating indicia;

c. said selector profile and said each selectable profile segment sufficiently complimentary in shape to allow the retentive engagement area of the selector profile to retentively engage with the retentive engagement area of the selectable profile segment;

d. at least one of said selector profile and said one of said selected profile segments resiliently deforming to allow said area of said selector profile to engage said area of said selected profile segment;

e. said selector profile of said selector profile member slideably engageable with one of said profile segments of said selectable profile member to each of said retentive engagement areas of said selectable profile member, such that the selector profile retentive engagement area located at a first said retentive engagement area of a first one of said profile segments selected by said selector profile is relocated from said first retentive engagement area to a second said retentive engagement area of a second one of said profile segments selected by said selector profile;

f. a first one of said cooperating selector profile member and said cooperating selectable profile member including at least one cooperating rib profile and the second one of said cooperating profile members including at least one channel profile cooperating with said cooperating rib profile;

g. said selectable member capable of attaching to substantially planar flat surfaces and to curved surfaces and said selectable member capable of conforming to the substantially planar flat geometry of the substantially planar flat surfaces and capable of conforming to the curved geometry of the curved surfaces, and said selectable member capable of conforming to said geometries while maintaining the slideability of the selector member to each of said retentive engagement areas of said selectable member.

33. The method of claim 32 wherein the selector member profile retentively engaged with a selected first of said plurality of profile segments, remains at said first selected profile segment by way of said selector member profile keeping said first selected profile segment resiliently deformed.

34. The method of claim 32 wherein the surface to which said selectable member is capable of attaching and conforming has a radius of curvature greater than 14 mm and less than infinity.

35. The method of claim 32 and further distinguishing said first selectable profile segment of said selectable profile member from said second selectable profile segment of said selectable profile member by way of a demarcation between said first and said second profile segments, said demarcation being one chosen from a list which includes; a cut between said first and said second profile segments, an opening between said first and said second profile segments.

* * * * *